US009658565B2

(12) United States Patent
Oida et al.

(10) Patent No.: US 9,658,565 B2
(45) Date of Patent: May 23, 2017

(54) DEVELOPING DEVICE, IMAGE FORMING APPARATUS, METHOD OF DETECTING DEVELOPER AMOUNT, AND NON-TRANSITORY RECORDING MEDIUM STORING PROGRAM

(71) Applicants: Takashi Oida, Osaka (JP); Shoh Tsuritani, Osaka (JP); Tomohiro Ohshima, Osaka (JP); Akinori Yamaguchi, Osaka (JP); Mizuho Ohmura, Osaka (JP)

(72) Inventors: Takashi Oida, Osaka (JP); Shoh Tsuritani, Osaka (JP); Tomohiro Ohshima, Osaka (JP); Akinori Yamaguchi, Osaka (JP); Mizuho Ohmura, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/049,707

(22) Filed: Feb. 22, 2016

(65) Prior Publication Data

US 2016/0246213 A1 Aug. 25, 2016

(30) Foreign Application Priority Data

Feb. 22, 2015 (JP) ..... 2015-032379

(51) Int. Cl.
*G03G 15/08* (2006.01)

(52) U.S. Cl.
CPC ..... *G03G 15/0856* (2013.01); *G03G 15/0831* (2013.01); *G03G 15/0848* (2013.01);
(Continued)

(58) Field of Classification Search
CPC ..... G03G 15/0827; G03G 15/0831; G03G 15/0856; G03G 15/0862; G03G 2215/0888; G03G 2215/0891
(Continued)

(56) References Cited

U.S. PATENT DOCUMENTS

2011/0076036 A1* 3/2011 Hiraike ..... G03G 15/553 399/27
2011/0217055 A1 9/2011 Takehara et al.
(Continued)

FOREIGN PATENT DOCUMENTS

JP 2005-128308 5/2005
JP 2007121646 A * 5/2007
JP 2011-186038 9/2011

*Primary Examiner* — Robert Beatty
(74) *Attorney, Agent, or Firm* — Oblon, McClelland, Maier & Neustadt, L.L.P.

(57) ABSTRACT

A developing device includes a development unit, a developer amount detector, an accuracy requirement determiner, and a detection count setting unit. The development unit includes a developer container configured to store a developer. The development unit is configured to supply the developer from the developer container to a latent image bearer, on which an electrostatic latent image is to be formed according to image data, to form a developer image. The developer amount detector is configured to detect a developer amount in the toner container of the development unit in every detection period. The accuracy requirement determiner is configured to a determine accuracy requirement required as a detection accuracy of the developer amount by the developer amount detector. The detection count setting unit is configured to set a number of times of detection of the developer amount by the developer amount detector based on the accuracy requirement.

9 Claims, 15 Drawing Sheets

(52) U.S. Cl.
CPC . *G03G 15/0862* (2013.01); *G03G 2215/0132* (2013.01); *G03G 2215/0888* (2013.01); *G03G 2215/0891* (2013.01)

(58) Field of Classification Search
USPC ..... 399/27, 61, 64, 258
See application file for complete search history.

(56) References Cited

U.S. PATENT DOCUMENTS

| | | | | |
|---|---|---|---|---|
| 2012/0106990 | A1* | 5/2012 | Kayahara ..... | G03G 15/086 399/27 |
| 2014/0226995 | A1 | 8/2014 | Oida | |
| 2015/0125167 | A1* | 5/2015 | Yamaguchi ..... | G03G 15/0831 399/27 |
| 2015/0147076 | A1 | 5/2015 | Oida | |

* cited by examiner

FIG. 6

| MEASUREMENT TIMES OF TRANSMISSION TIME (Ms<Ml) | DETECTION ACCURACY | DETECTION TIME | INFLUENCE TO PRODUCTIVITY |
|---|---|---|---|
| Ml | HIGH | LONG (T × Ml) | INFLUENCE IS PRESENT<br>IMAGE FORMING OPERATION<br>TONER REMAINING AMOUNT DETECTING OPERATION<br>DOWNTIME<br>IMAGE FORMATION<br>TONER REMAINING AMOUNT DETECTION<br>T1 T21 TM |
| Ms | LOW | SHORT (T × Ms) | NO INFLUENCE<br>IMAGE FORMING OPERATION<br>TONER REMAINING AMOUNT DETECTING OPERATION<br>NO DOWNTIME<br>IMAGE FORMATION<br>TONER REMAINING AMOUNT DETECTION<br>T1 T21 TM |

DEVELOPING DEVICE, IMAGE FORMING APPARATUS, METHOD OF DETECTING DEVELOPER AMOUNT, AND NON-TRANSITORY RECORDING MEDIUM STORING PROGRAM

CROSS-REFERENCE TO RELATED APPLICATION

This patent application is based on and claims priority pursuant to 35 U.S.C. §119(a) to Japanese Patent Application No. 2015-032379, filed on Feb. 22, 2015, in the Japan Patent Office, the entire disclosure of which is hereby incorporated by reference herein.

BACKGROUND

Technical Field

Aspects of the present disclosure relate to a developing device, an image forming apparatus, a method of detecting a developer amount, and a non-transitory recording medium storing a program for causing a control processor to execute the method.

Related Art

An electrophotography image forming apparatus provides a developer such as a toner (hereinafter, the developer is referred to as toner) from a developing section to a latent image bearer such as a photoconductor (hereinafter, the latent image bearer is referred to as photoconductor) on which an electrostatic latent image is formed, and forms a developer image such as a toner image (hereinafter, the developer image is referred to as toner image).

This developing section typically rotates a stirring screw in a toner container, mixes a nonmagnetic toner and a magnetic carrier, improve uniformity of an old toner and a new toner, transfers the toner to the photoconductor in a transfer device, and forms the toner image on the photoconductor.

Further, the developing section supplies the toner from a high-capacity supply container to the toner container. Then, the image forming apparatus conventionally detects a toner amount (developer amount) in the toner container of the developing section, and performs toner supply control such as control of supply timing and supply termination timing of the toner from the supply container to the toner container, in order to prevent blur of an image due to lack of the toner.

As methods of detecting the toner amount in the toner container, there are various methods. Among them, as a toner amount detection method having a cheap and simple configuration, a light transmission-type toner amount detection method is known, which disposes a light-emitting element and a light-receiving element across a toner container, projecting detection light from the light-emitting element toward the light-receiving element, transmits a toner stirred with a stirring screw, and detects a toner amount according to a time during which the detection light projected from the light-emitting element is incident on the light-receiving element.

SUMMARY

In an aspect of the present disclosure, there is provided a developing device that includes a development unit, a developer amount detector, an accuracy requirement determiner, and a detection count setting unit. The development unit includes a developer container configured to store a developer. The development unit is configured to supply the developer from the developer container to a latent image bearer, on which an electrostatic latent image is to be formed according to image data, to form a developer image. The developer amount detector is configured to detect a developer amount in the toner container of the development unit in every detection period. The accuracy requirement determiner is configured to a determine accuracy requirement required as a detection accuracy of the developer amount by the developer amount detector. The detection count setting unit is configured to set a number of times of detection of the developer amount by the developer amount detector based on the accuracy requirement.

In another aspect of the present disclosure, there is provided an image forming apparatus that include the image bearer configured to bear an electrostatic latent image based on image data. The development unit is configured to supply the developer to the image bearer to form a developer image on the image bearer.

In still another aspect of the present disclosure, there is provided a method of detecting a developer amount. The method includes supplying, by a development unit including a developer container to store a developer, the developer from the developer container to a latent image bearer, on which an electrostatic latent image is formed according to image data, to form a developer image; detecting a developer amount in the toner container of the development unit in every detection period; determining an accuracy requirement required as a detection accuracy of the developer amount by the detecting of the developer amount; and setting a number of times of detection of the developer amount in the detecting of the developer amount, based on the accuracy requirement.

In still yet another aspect of the present disclosure, there is provided a non-transitory recording medium storing a program for causing a control processor to execute a method. The method includes supplying, by a development unit including a developer container to store a developer, the developer from the developer container to a latent image bearer, on which an electrostatic latent image is formed according to image data, to form a developer image; detecting a developer amount in the toner container of the development unit in every detection period; determining an accuracy requirement required as a detection accuracy of the developer amount by the detecting of the developer amount; and setting a number of times of detection of the developer amount in the detecting of the developer amount, based on the accuracy requirement.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein:

FIG. 6 is a diagram illustrating relationship among the number of times of toner amount detection, detection accuracy, a detection time, and an influence on productivity according to an embodiment;

Figure 1:
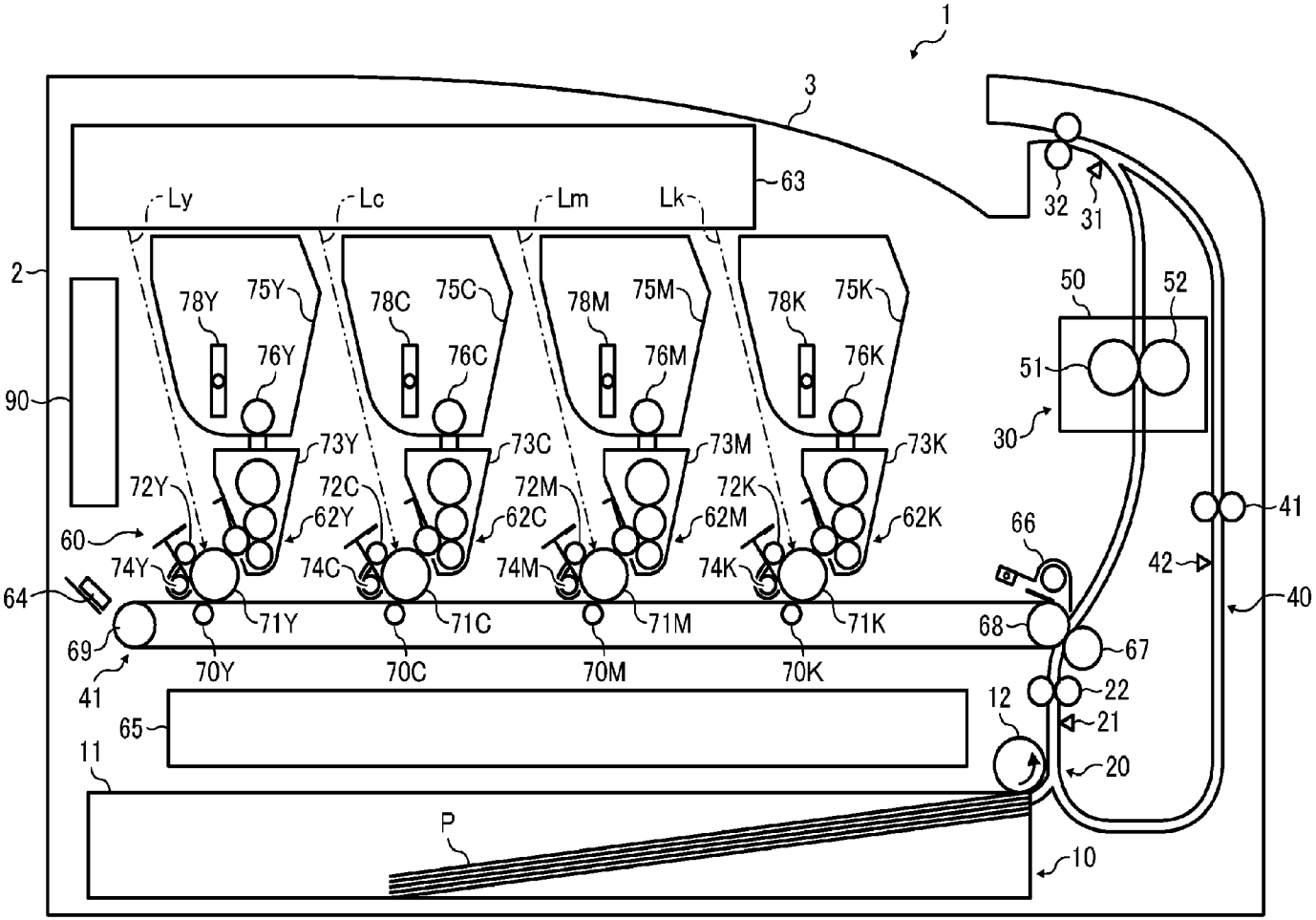
FIG. 1 is a schematic view of a configuration of an image forming apparatus to which an embodiment of the present disclosure is applied.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

In the following description, illustrative embodiments will be described with reference to acts and symbolic representations of operations (e.g., in the form of flowcharts) that may be implemented as program modules or functional processes including routines, programs, objects, components, data structures, etc., that perform particular tasks or implement particular abstract data types and may be implemented using existing hardware at existing network elements or control nodes. Such existing hardware may include one or more Central Processing Units (CPUs), digital signal processors (DSPs), application-specific-integrated-circuits, field programmable gate arrays (FPGAs) computers or the like. These terms in general may be referred to as processors.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

Hereinafter, favorable embodiments of the present disclosure will be described in detail based on the attached drawings. Note that the embodiments to be described below are mere favorable embodiments of the present disclosure, and thus technically favorable various limitations are included. However, the scope of the present disclosure is not unreasonably limited by the description below, and not all of configurations to be described in the present embodiment are essential requirements of the present disclosure.

As described above, as a method of detecting the amount of toner in a toner container, the light transmission-type toner amount detection method is known. The light transmission-type toner amount detection method detects toner in a toner container in every certain detection period. Since the toner stirred with the stirring screw is detected, detection accuracy is improved as the detection period is shorter and the number of times of detection is larger.

For example, the toner stored in the toner container is stirred and conveyed with the stirring screw attached to the toner container, and is circulated. The light-transmission-type toner amount detection method detects the toner amount using correlation between a time when the toner passes through a light transmission surface to shade the light in a rotation period of the stirring screw, and the toner amount in the toner container.

However, the light transmission-type toner amount detection method generally removes noise by circulating the toner with the stirring screw many times, and measuring a transmission time a plurality of times, in a shorter period than the rotation period, in order to detect the toner amount with high accuracy.

Meanwhile, an image forming apparatus performs image formation while measuring the toner amount. Therefore, if the number of times of detection is increased, and the detection of the toner amount is performed for a long time, a situation that a next image formation operation is forced to wait during the toner amount detection operation, even though the image formation operation has been terminated. As a result, utility of the image forming apparatus and the developing device may be reduced.

As described below, according to at least one embodiment of the present disclosure, the appropriately accurate detection of the developer amount can be performed while the utility can be maintained.

[Embodiment 1]

FIGS. 1 to 15 are diagrams illustrating an embodiment of a developing device, an image forming apparatus, a developer amount detection method, and a developer amount detection program of the present disclosure. FIG. 1 is a schematic view of a configuration of a color image forming apparatus 1 to which an embodiment of a developing device, an image forming apparatus, a developer amount detection method, and a developer amount detection program of the present disclosure is applied.

In FIG. 1, the color image forming apparatus 1 houses a sheet feed device 10, a sheet conveyance device 20, a sheet ejection-and-conveyance device 30, a duplex conveyance device 40, a fixing device 50, an image forming device 60, a control board 90, and the like in a body housing 2. The color image forming apparatus 1 includes a sheet ejection tray 3 in an upper part of the body housing 2, an operation panel 4 (see FIGS. 2A and 2B), and the like.

Note that, in the description below, the image forming apparatus 1 is described to perform print processing of print data of a print job received from a host apparatus such as an external computer through a network such as a local area network (LAN) or the like. However, the image forming apparatus 1 may include image data input sections such as a scanner section and a facsimile section, and perform print processing (image formation processing) based on the image data from the image data input sections.

The sheet feed device 10 includes a sheet feeding tray 11, a sheet feed roller 12, a separation pad, and the like, and a plurality of sheets P is housed in the sheet feeding tray 11. The sheet feed device 10 separates the sheets P in an uppermost tray of the sheet feeding tray 11 one by one with the sheet feed roller 12 and the separation pad, and sends the sheet to the sheet conveyance device 20.

The sheet conveyance device 20 is connected to the sheet ejection-and-conveyance device 30, and conveys the sheet P sent from the sheet feed device 10 to the sheet ejection-and-conveyance device 30. A registration sensor 21 and registration rollers 22 are disposed in a conveyance direction (sub-scanning direction) of the sheet P in the sheet conveyance device 20, and the registration sensor 21 detects the sheet P conveyed on the sheet conveyance device 20 from the sheet feed device 10 to the registration rollers 22. The registration rollers 22 are driven and controlled to once stop the conveyed sheet P based on a detection result of the sheet P by the registration sensor 21, then adjust transfer timing of a toner image on the sheet P by the image forming device 60, and resume the conveyance.

The fixing device 50, a sheet ejection sensor 31, sheet ejection rollers 32, and the like are disposed in the sheet ejection-and-conveyance device 30, and the fixing device 50 conveys the sheet P on which the toner image (developer image) is transferred in the image forming device 60 while heating and pressurizing the sheet P to fix the toner image on the sheet P. The sheet ejection-and-conveyance device 30 conveys the sheet P on which the toner image is fixed in the fixing device 50 to the sheet ejection rollers 32. The sheet ejection sensor 31 detects the sheet P conveyed from the fixing device 50 to the sheet ejection rollers 32. The sheet ejection rollers 32 eject the sheet P on which fixation of the toner image has been completed, onto the sheet ejection tray 3.

Further, the sheet ejection-and-conveyance device 30 is connected to the duplex conveyance device 40 near a position where the sheet ejection sensor 31 is disposed, which is a downstream side of the fixing device 50, and the duplex conveyance device 40 is connected to the sheet conveyance device 20 near the sheet feed device 10.

In a duplex print mode, the image forming apparatus 1 stops driving of the sheet ejection rollers 32 at timing when a rear end of the sheet P to which simplex printing has been completed passes through the sheet ejection sensor 31, and then drives and reverses the sheet ejection rollers 32, and sends the sheet P to the duplex conveyance device 40.

The duplex conveyance device 40 includes a duplex roller 41, a duplex sensor 42, and the like, and sends the sheet P sent with the sheet ejection rollers 32 to the sheet conveyance device 20 with the duplex roller 41 while reversing front and back surfaces of the sheet P, and detects the sheet P with the duplex sensor 42. As the registration sensor 21, the sheet ejection sensor 31, and the duplex sensor 42, a reflection-type or a transmission-type photo-coupler is used.

The sheet conveyance device 20 brings the sheet P sent from the duplex conveyance device 40 to be subjected to image formation by the image forming device 60 through the registration rollers 22, and conveys the sheet P to the sheet ejection-and-conveyance device 30.

The image forming device 60 is a so-called tandem-type image forming device, and includes an intermediate transfer belt 61 formed in an endless belt and ring shaped manner, and is stretched over in an approximately horizontal direction, developing units 62K, 62M, 62C, and 62Y for respective colors of K (black), M (magenta), Y (yellow), and C (cyan) arranged and disposed along the intermediate transfer belt 61, an exposure device 63, a toner mark sensor 64, a waste toner box 65, an intermediate transfer belt cleaner 66, a secondary transfer roller 67, and the like. The intermediate transfer belt 61 is stretched over a secondary transfer drive roller 68 and a tension roller 69. In the image forming apparatus 1, primary transfer rollers 70K, 70M, 70C, and 70Y for respective CMYK colors corresponding to the developing units 62K, 62M, 62C, and 62Y are disposed across the intermediate transfer belt 61.

The developing units 62K, 62M, 62C, and 62Y are unit toners in which chargers 72K, 72M, 72C, and 72Y, developing sections 73K, 73M, 73C, and 73Y, cleaning devices 74K, 74M, 74C, and 74Y, and the like are disposed in order around photoconductors (latent image bearers) 71K, 71M, 71C, and 71Y driven and rotated in a clockwise direction in FIG. 1, respectively. Insides of the respective developing sections 73K, 73M, 73C, and 73Y serve as toner containers that store a toner Tu (developer). Toner containers (developer supply containers) 75K, 75M, 75C, and 75Y that supply the toner Tu to the toner containers are disposed above the developing sections 73K, 73M, 73C, and 73Y. The toner containers 75K, 75M, 75C, and 75Y are detachably mounted to the developing units 62K, 62M, 62C, and 62Y, and are replaced with new toner containers 75K, 75M, 75C, and 75Y when the stored toner Tu runs out.

Figure 2B:
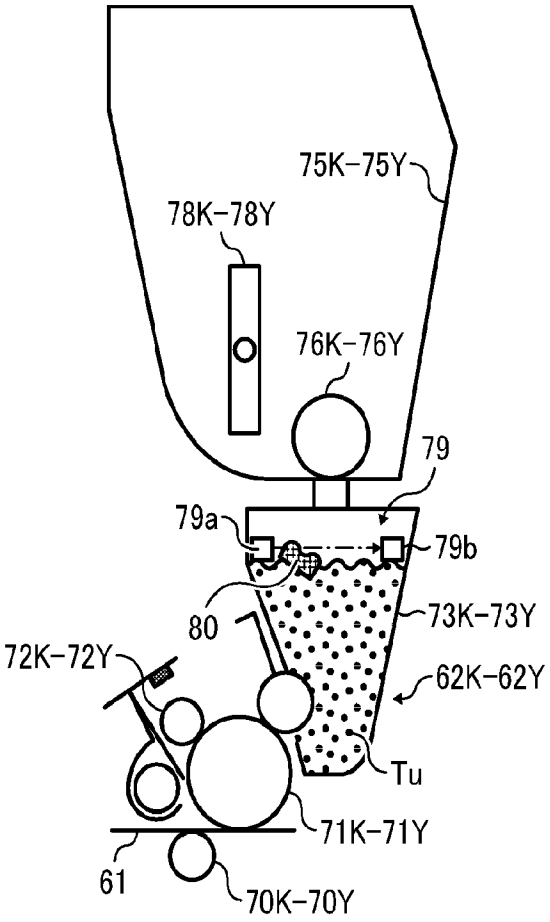
FIGS. 2A and 2B are schematic views of configurations of a developing unit and a toner supply unit in cases with a small amount of toner and with a large amount of toner according to an embodiment.
Figure 2A:
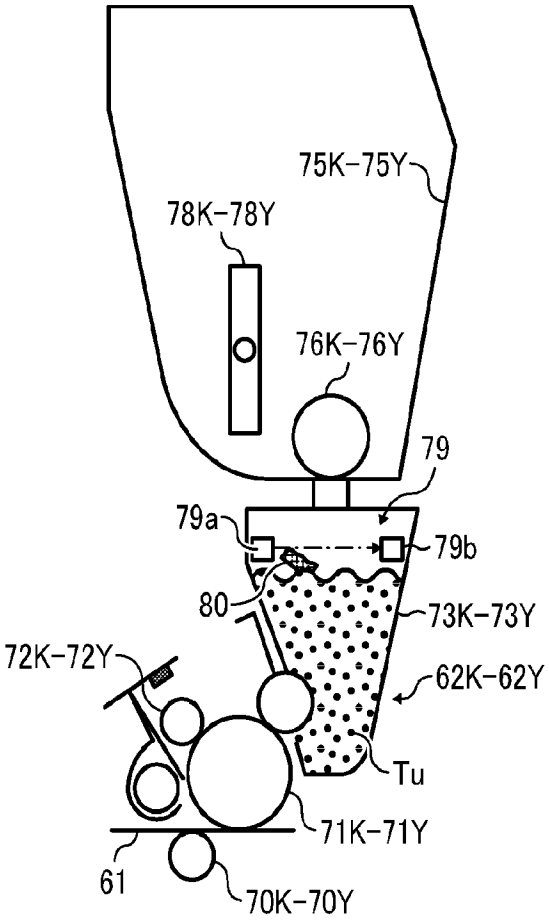
Figure 4:
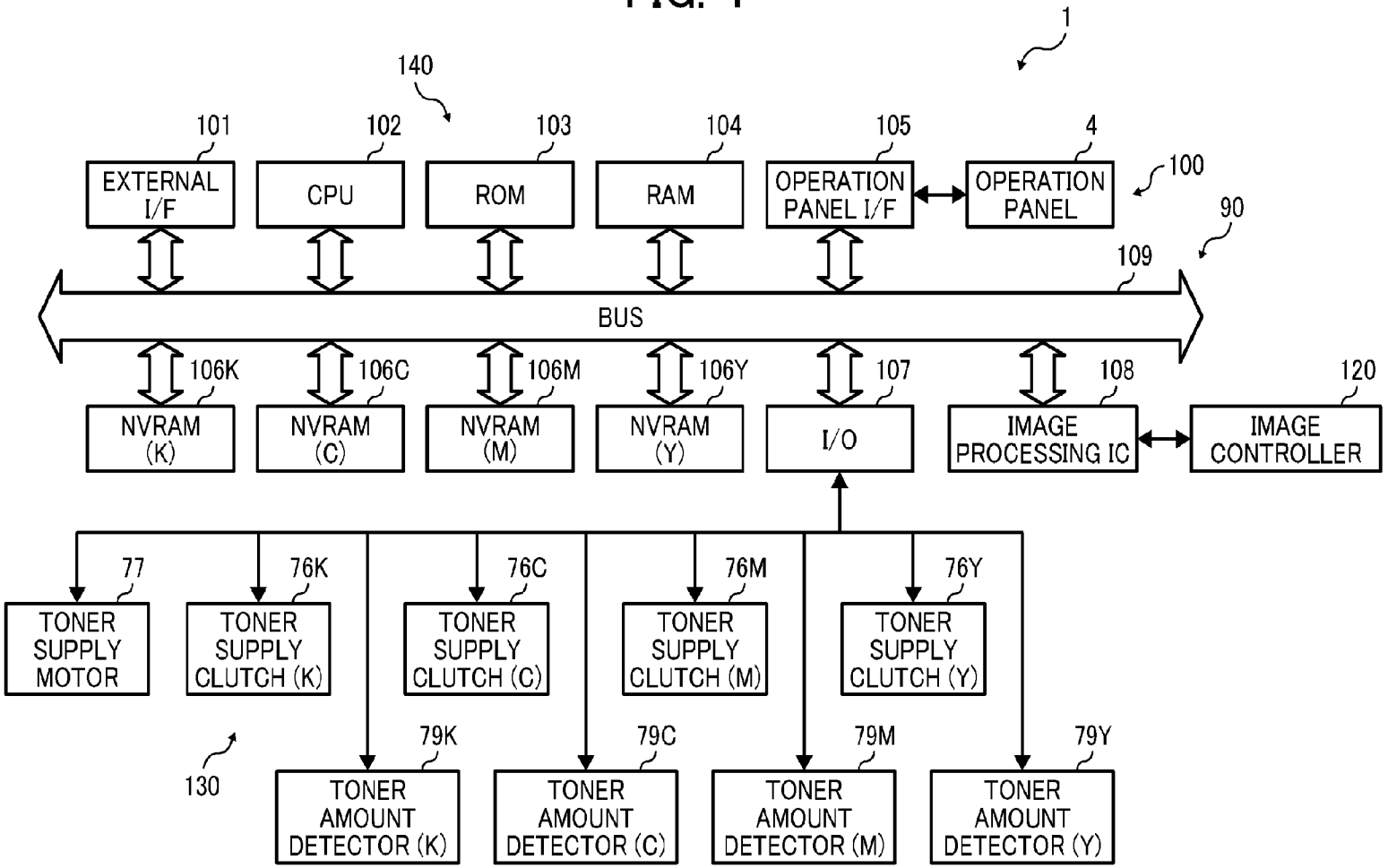
FIG. 4 is a partial block diagram of a configuration of the image forming apparatus according to an embodiment.

That is, as illustrated in FIGS. 2A and 2B, the toner containers 75K, 75M, 75C, and 75Y include toner supply clutches 76K, 76M, 76C, and 76Y, and a toner supply motor 77 (see FIG. 4). The toner supply clutches 76K, 76M, 76C, and 76Y are subjected to ON/OFF operation by a central processing unit (CPU) 102 described below, thereby to perform/stop supply the toners Tu from the toner containers 75K, 75M, 75C, and 75Y to the respective developing sections 73K, 73M, 73C, and 73Y.

The toner supply motor 77 is connected to toner supply screws 78K, 78M, 78C, and 78Y rotatably housed in the toner containers 75K, 75M, 75C, and 75Y. The toner supply motor 77 is driven and operated under control of the CPU 102, rotates and drives the toner supply screws 78K, 78M, 78C, and 78Y to send the toner Tu in the toner containers 75K, 75M, 75C, and 75Y to the toner supply clutches 76K, 76M, 76C, and 76Y, and sends the toner Tu to the respective developing sections 73K, 73M, 73C, and 73Y.

The respective developing units 62K, 62M, 62C, and 62Y are housed and mounted in the body housing 2 of the image forming apparatus 1 in a state where the photoconductors 71K, 71M, 71C, and 71Y can face and are in a contactable state with the primary transfer rollers 70K, 70M, 70C, and 70Y for the respective colors across the intermediate transfer belt 61. The intermediate transfer belt 61 is conveyed between the photoconductors 71K, 71M, 71C, and 71Y of the respective developing units 62K, 62M, 62C, and 62Y and the primary transfer rollers 70K, 70M, 70C, and 70Y. Note that the primary transfer rollers 70K, 70M, 70C, and 70Y are used to transfer toner images on the photoconductors 71K, 71M, 71C, and 71Y to the intermediate transfer belt 61. Only the primary transfer rollers 70K, 70M, 70C, and 70Y at transfer operation timing are positioned in positions facing the photoconductors 71K, 71M, 71C, and 71Y, and the primary transfer rollers 70K, 70M, 70C, and 70Y at timing other than the transfer operation timing are retracted to positions separated from the positions facing the photoconductors 71K, 71M, 71C, and 71Y.

The exposure device 63 uses a light emitting diode (LED) array, and the like, and irradiates the photoconductors 71K, 71M, 71C, and 71Y of corresponding colors with exposure light Lk, Lm, Lc, and Ly for the respective KMCY colors modulated with image data.

The image forming device 60 supplies the toner Tu of respective colors onto the photoconductors 71K, 71C, 71M, and 71Y by the developing sections 73K, 73M, 73C, and 73Y while rotating the photoconductors 71K, 71C, 71M, and 71Y on which the electrostatic latent images are formed by the exposure device 63 in a clockwise direction, and develops the electrostatic latent images to form toner images (developer images) of respective colors. The image forming device 60 superimposes and transfers the toner images of respective colors on the intermediate transfer belt 61 with the primary transfer rollers 70K, 70M, 70C, and 70Y from the photoconductors 71K, 71C, 71M, and 71Y on which the toner images of respective colors are formed to form a color toner image. The image forming device 60 further rotates the photoconductors 71K, 71C, 71M, and 71Y from which the transfer of the toner images has been completed, removes a residual toner Tu with the cleaning devices 74K, 74M, 74C, and 74Y, charges the photoconductors 71K, 71C, 71M, and 71Y with the chargers 72K, 72M, 72C, and 72Y again, and brings the photoconductors 71K, 71C, 71M, and 71Y to be subjected to the image formation.

The image forming device 60 sends the waste toner removed with the cleaning devices 74K, 74M, 74C, and 74Y to the waste toner box 65, and the image forming apparatus 1 outputs a message that prompts replacement with a new waste toner box 65 to an operation display when a waste toner full detection sensor detects that the waste toner in the waste toner box 65 is full.

The intermediate transfer belt 61 is driven and rotated in a counterclockwise direction in FIG. 1 with the secondary transfer drive roller 68 driven and rotated by a drive motor. The intermediate transfer belt 61 transfers, with a transfer potential of the secondary transfer roller 67, the toner image on the intermediate transfer belt 61 onto the sheet P conveyed to a secondary transfer drive roller 68 portion between the secondary transfer drive roller 68 and the secondary transfer roller 67 from the registration rollers 22.

The fixing device 50 includes a rotatably disposed fixing roller 51, a pressure roller 52, and the like. The fixing roller 51 is heated to a predetermined fixing temperature by a fixing heater. The fixing device 50 conveys the sheet P while heating and pressurizing the sheet P with the fixing roller 51 heated to the fixing temperature and the pressure roller 52, and fixes the toner image on the sheet P to the sheet P, when the sheet P on which the toner image has been transferred is conveyed between the fixing roller 51 and the pressure roller 52.

The sheet ejection-and-conveyance device 30 conveys the sheet P on which the toner image has been fixed in the fixing device 50 to the sheet ejection rollers 32, as described above. The sheet ejection sensor 31 detects the sheet P conveyed from the fixing device 50 to the sheet ejection rollers 32. The sheet ejection rollers 32 eject the sheet P on which fixation of the toner image has been completed onto the sheet ejection tray 3 in the case of simplex printing or when printing to a back surface of duplex printing has been completed.

The developing sections 73K, 73M, 73C, and 73Y respectively include toner amount detectors 79, as illustrated in FIGS. 2A and 2B. The toner amount detector 79 includes a light-emitting element 79*a* and a light-receiving element 79*b*. The light-emitting element 79*a* uses a light emitting diode (LED) or the like, and projects detection light toward the light-receiving element 79*b*. The light-receiving element 79*b* uses a photodiode, for example, and outputs a detection signal (a detection current or a detection voltage) according to an input light amount.

Further, the developing sections 73K, 73M, 73C, and 73Y respectively includes stirring screws 80 therein, as illustrated in FIGS. 2A and 2B. The stirring screw 80 is driven and rotated in a preset rotation period (stirring period) T by a drive motor. The stirring screw 80 stirs the toner Tu in the developing section 73K, 73M, 73C, or 73Y by being driven and rotated, mixes a nonmagnetic toner with a magnetic carrier, and improves uniformity of an old toner Tu and a new toner Tu.

The stirring screw 80 is disposed in a state of being positioned on a projected light line of the detection light of the toner amount detector 79.

Further, a cleaner is attached to the stirring screw 80 in order to prevent erroneous detection due to adhering of the toner Tu to the light-emitting element 79*a* and the light-receiving element 79*b*. The cleaner is rotated in accordance with rotation of the stirring screw 80, and removes the toner Tu adhering to the light-emitting element 79*a* and the light-receiving element 79*b*. By rotation of the stirring screw 80, the toner Tu in the developing section 73K, 73M, 73C, or 73Y is placed onto the stirring screw 80 itself or the cleaner.

Figure 3A:
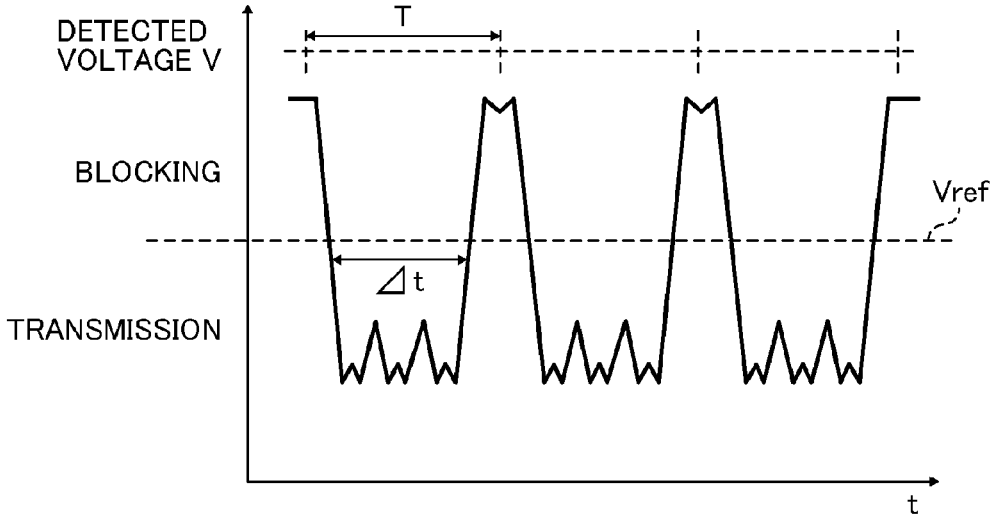
FIGS. 3A and 3B are diagrams illustrating examples of a detection signal corresponding to the toner amounts illustrated in FIGS. 2A and 2B according to an embodiment.
Figure 3B:
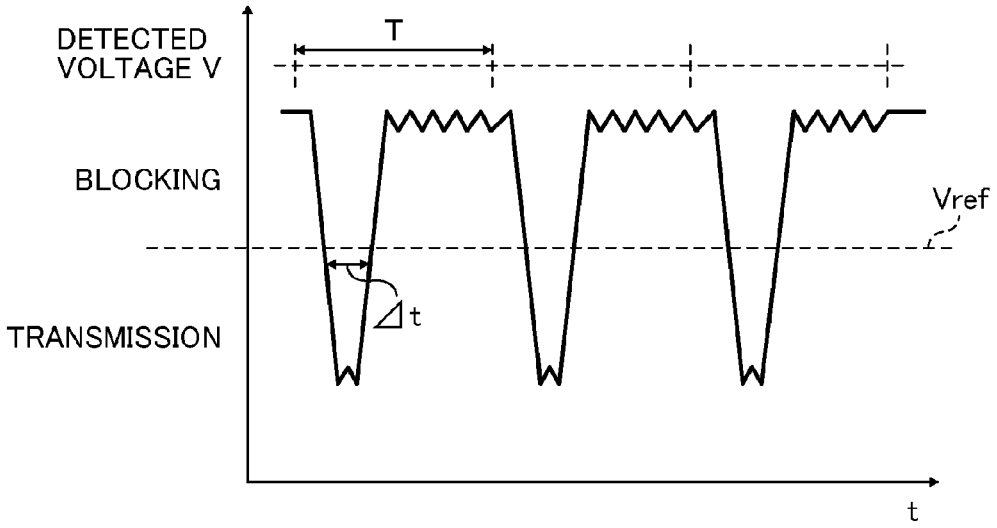

The toner amount detector 79 outputs the detection signals as illustrated in FIGS. 3A and 3B according to the toner amounts of FIGS. 2A and 2B by detecting the toner Tu placed on the stirring screw 80 including the cleaner. That is, the toner amount detector 79 outputs the detection signal with a relatively long transmission time $\Delta t$, as illustrated in FIG. 3A, when the toner amount in the developing section 73K, 73M, 73C, or 73Y is relatively small, as illustrated in FIG. 2A. The transmission time $\Delta t$ is a time when the toner Tu is small and the light is transmitted in a detection period. Further, the toner amount detector 79 outputs the detection signal with a relatively short transmission time $\Delta t$, as illustrated in FIG. 3B, when the toner amount in the developing section 73K, 73M, 73C, or 73Y is large, as illustrated in FIG. 2B. Note that, in FIGS. 3A and 3B, T represents a rotation period T of the stirring screw 80, and the transmission time $\Delta t$ indicates a time when a detection voltage V of the toner amount detector 79 is less than a predetermined threshold Vref in one rotation period T of the stirring screw 80.

Then, the transmission time $\Delta t$ changes according to the toner amount in the developing section 73K, 73M, 73C, or 73Y, and the toner amount in the developing section 73K, 73M, 73C, or 73Y can be detected from a ratio of the transmission time Δt to the rotation period T. To be specific, the image forming apparatus 1 compares the detection voltage V of the light-receiving element 79*b* with the preset threshold Vref in a predetermined sampling period (toner detection period) that is shorter than the rotation period T. The image forming apparatus 1 replaces a comparison result of the detection voltage V and the threshold Vref with the number of times of transmission and the number of times of cutoff of the detection signal in the toner amount detector 79, and obtains the ratio of the transmission time Δt to the rotation period T. Note that the image forming apparatus 1 is provided with the threshold Vref in order to determine transmission/cutoff of the detection light from the detection voltage V output by the light-receiving element 79*b*, and determines that the detection light has been transmitted when the detection voltage V is less than the threshold Vref and determines that the detection light has been cut off when the detection voltage V is the threshold Vref or more. Note that the transmission time Δt when the light is transmitted in each toner detection period changes according to the toner amount in the toner container. Therefore, the image forming apparatus 1 can detect the toner amount in the developing section 73K, 73M, 73C, or 73Y from the ratio of the transmission time Δt to the rotation period T. To be specific, the image forming apparatus 1 confirms an output value of the light-emitting element 79*a* in a predetermined sampling period (toner detection period) that is shorter than the rotation period T, replaces the output value with the number of times of transmission and the number of times of cutoff of light in the rotation period T, and obtains the toner amount from the ratio.

Further, as illustrated in FIG. 4, the image forming apparatus 1 mounts a main controller 100 and an image controller 120 in the control board 90.

The main controller 100 includes an external interface (I/F) 101, a central processing unit (CPU) 102, a read only memory (ROM) 103, a random access memory (RAM) 104, an operation panel I/F 105, nonvolatile random access memories (NVRAMs) 106K, 106M, 106C, and 106Y for K, M, C, and Y, an input/output (I/O) 107, an image processing integrated circuit (IC) 108, and the like. The respective units of the main controller 100 are connected with a bus 109.

The toner supply motor 77, the toner supply clutches 76K, 76M, 76C, and 76Y, and the toner amount detectors 79K, 79C, 79M, and 79Y are connected to the I/O 107.

The toner supply motor 77 and the toner supply clutches 76K, 76M, 76C, and 76Y of the respective colors are built as a toner supply unit 130 as a whole.

The toner supply clutches 76K, 76M, 76C, and 76Y are subjected to the ON/OFF operation by the CPU 102, thereby to perform/stop supply the toners from the toner containers 75K, 75M, 75C, and 75Y to the respective developing sections 73K, 73M, 73C, and 73Y.

The toner supply motor 77 is driven and operated under control of the CPU 102, and conveys the toners in the toner containers 75K, 75M, 75C, and 75Y to the respective developing sections 73K, 73M, 73C, and 73Y.

As described above, the toner amount detectors 79K, 79C, 79M, and 79Y detect amounts of the toners stored in the respective developing sections 73K, 73M, 73C, and 73Y, and output toner amount signals to the CPU 102. The toner amount detectors 79K, 79C, 79M, and 79Y output, as the toner amount signals, voltage signals detected in a sampling period that is shorter than one rotation period T of the stirring screw 80, as illustrated in FIGS. 3A and 3B.

In the ROM 103, a basic program as the image forming apparatus 1, a developer amount detection program for executing a developer amount detection method of the present disclosure, various types of data necessary to execute the programs, and the like are stored. The RAM 104 is used as a work memory of the CPU 102.

The CPU 102 controls the respective units of the image forming apparatus 1 while using the RAM 104 as a work memory, based on the programs in the ROM 103, and executes basic processing as the image forming apparatus 1 and executes the developer amount detection method of the present disclosure.

A computer or the like is connected as an external device to the external I/F 101 through a dedicated cable, a network, or the like. The external I/F 101 serves as an interface to receive print data or a print job such as print setting from the external device or and to transfer a print result or print state information to the external device, under control of the CPU 102.

The operation panel 4 is connected to the operation panel I/F 105, and the operation panel 4 includes various operation keys and a display (for example, a liquid crystal display). Through the operation panel 4, various operations necessary to cause the image forming apparatus 1 to perform the image formation operation are performed with the operation keys, and especially, various setting operations necessary in the developer amount (toner amount) detection processing are performed are performed, and the operation panel 4 passes operation content to the CPU 102 through the operation panel I/F 105. The operation panel 4 displays, on its display, various types of information to be notified from the image forming apparatus 1 to a user, especially, various types of information related to the toner amount detection processing, under control of the CPU 102.

The NVRAMs 106K, 106C, 106M, and 106Y are attached to the toner containers 75K, 75M, 75C, and 75Y of the respective corresponding colors. The NVRAMs 106K, 106C, 106M, and 106Y store the toners Tu stored in the toner containers 75K, 75M, 75C, and 75Y toner related information necessary for management of the toner amounts to be supplied to the developing sections 73K, 73M, 73C, and 73Y.

The image processing IC 108 is connected to the image controller 120, and the image controller 120 performs image processing necessary to form an image in the image forming device 60, for image data of print target (image formation target). Further, the image controller 120 passes the image data of the print target subjected to the image processing to the image processing IC 108.

The image processing IC 108 receives the image data from the image controller 120, and transmits the image data to the exposure device 63. The image processing IC 108 calculates a toner consumption amount per page from the image data received from the image controller 120, and passes the calculated toner consumption amount to the CPU 102 through the bus 109.

The CPU 102 calculates a predicted toner amount described below using the toner consumption amount passed from the image processing IC 108.

The main controller 100 that includes the external I/F 101, the CPU 102, the ROM 103, the RAM 104, the operation panel I/F 105, the NVRAMs 106K, 106M, 106C, and 106Y, the I/O 107, the image processing IC 108, and the like, and the toner supply unit 130 that includes the toner supply motor 77 and the toner supply clutches 76K, 76C, 76M, and 76Y, the toner amount detectors 79K, 79C, 79M, and 79Y, and the like function as a developing device 140 as a whole.

Further, the image forming apparatus 1 is built as an image forming apparatus in which the developing device 140 is mounted, the developing device 140 executing the developer amount detection method for performing appropriately accurate detection of the developer amount while maintaining the utility described below, by reading the developer amount detection program for executing the developer amount detection method of the present disclosure recorded in a computer-readable recording medium such as a ROM, an electrically erasable and programmable read only memory (EEPROM), an erasable and programmable read only memory (EPROM), a flash memory, a flexible disc, a compact disc read only memory (CD-ROM), a compact disc rewritable (CD-RW), a digital versatile disk (DVD), a secure digital (SD) card, a magneto-optical disc (MO), and introduces the read program to the ROM 103 and the like. This developer amount detection program is a computer-readable program written in legacy programming language or object-oriented programming language such as assembler, C, C++, C#, Java (registered trademark), and can be stored and distributed in the recording medium.

Figure 5:
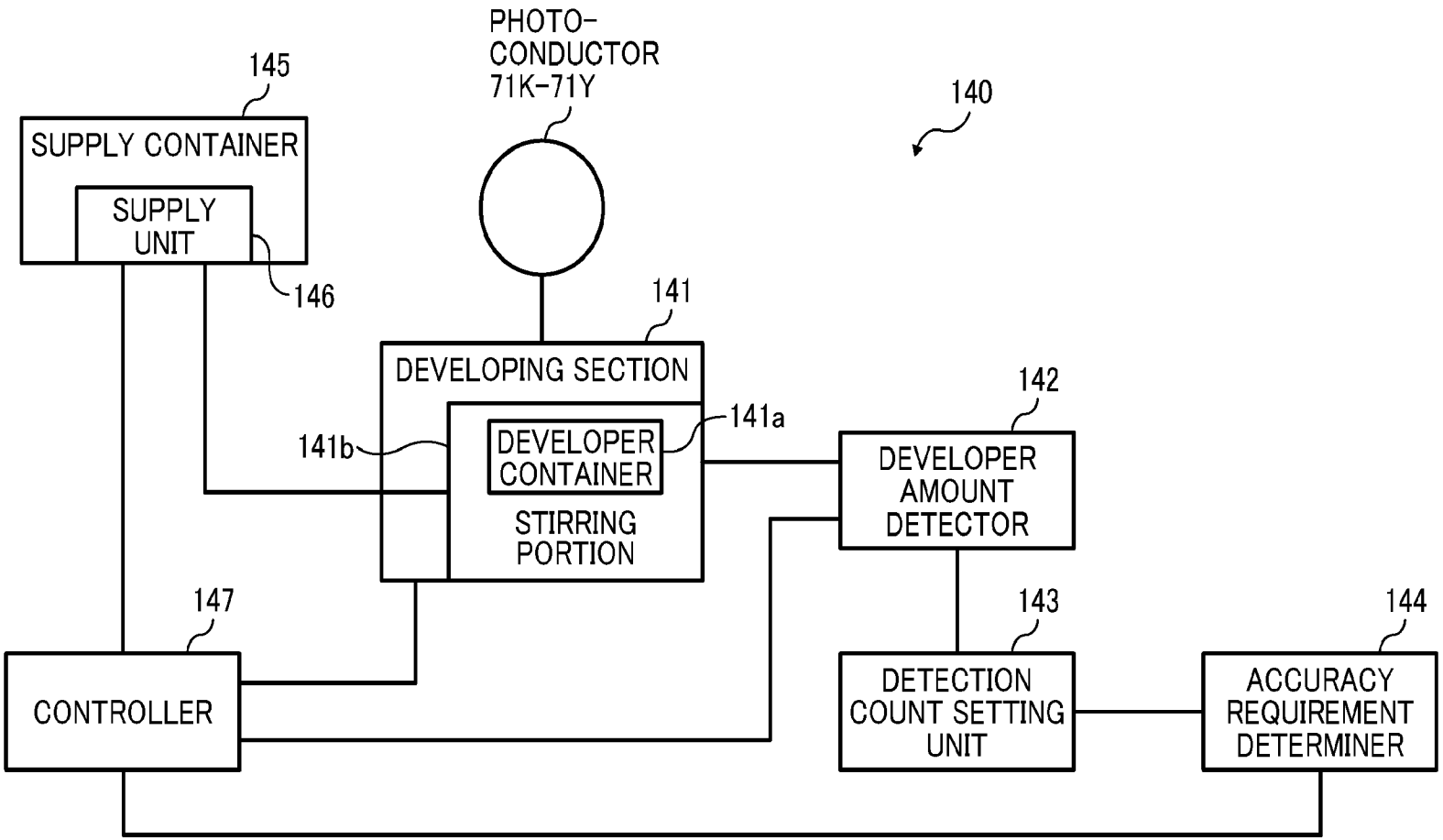
FIG. 5 is a functional block diagram of the developing device according to an embodiment.

The developer amount detection program of the present disclosure is introduced into the ROM 103, so that functional blocks of the developing device 140 of the image forming apparatus 1 as illustrated in FIG. 5 are built.

That is, the developer amount detection program is introduced, so that a developing section 141, a developer amount detector 142, a detection count setting unit 143, an accuracy requirement determiner 144, a supply container 145, a supply unit 146, a controller 147, and the like are built as the developing device 140 of the image forming apparatus 1.

The developing section 141 is built by the developing sections 73K, 73M, 73C, or 73Y, and include a toner container (developer container) 141*a* that stores the toner Tu as a developer, the toner container 141*a* being the inside of the developing section 73K, 73M, 73C, or 73Y. The number of developing sections 141 and toner containers 141*a* are built corresponding to the developing sections 73K, 73M, 73C, and 73Y, but are illustrated as the developing section 141 and the toner container 141*a* in FIG. 5. The developing section 141 supplies the toner Tu according to an electrostatic latent image formed on the photoconductor (latent image bearer) 71K, 71M, 71C or 71Y based on the image data of each of the respective colors K, C, M, and Y, and forms the toner image (developer image). Therefore, the toner Tu in the toner container 141*a* is consumed and decreased by an amount according to image density of the image data every time the developing operation (image formation operation) is performed.

Further, although not illustrated in FIG. 5, the developing section 141 includes a stirring portion 141*b* built by the stirring screw 80. The stirring portion 141*b* is driven and rotated in a predetermined rotation period T, and stirs the toner Tu in the toner container 141*a*. The developing section 141 functions as a development unit including the toner container 141*a*. The stirring portion 141*b* functions as a stirrer.

The supply container 145 is built by the toner containers 75K, 75M, 75C, or 75Y, and stores the developer, and functions as a supply container. Note that the supply containers 145 are provided in the respective developing sections 73K, 73M, 73C, and 73Y of the respective colors. However, only the supply container 145 is illustrated in FIG. 5, after the developing section 141.

The supply containers 145 include the supply units 146, respectively, and the supply units 146 are built by the toner supply unit 130 that includes the toner supply clutches 76K, 76M, 76C, and 76Y, and the toner supply motor 77. The supply unit 146 supplies the developer in the supply container 145 to the toner container 141*a*, and functions as a supply unit.

The developer amount detector 142 is built by the toner amount detector 79 that includes the light-emitting element 79*a* and the light-receiving element 79*b*. The developer amount detector 142 projects the detection light in a detection period that is shorter than the rotation period T, toward the toner Tu stirred in the rotation period T by the stirring portion 141*b*, and outputs the detection signal according to the light amount of transmission light that has transmitted the toner Tu to the controller 147. The developer amount detector 142 detects the toner amount (developer amount) in the toner container 141*a* of the developing section 141 in every detection period, and functions as a developer amount detector. In the description below, the developer is referred to as toner, the developer amount is referred to as toner amount, and the developer image is referred to as toner image, appropriately.

The accuracy requirement determiner 144 is built by the CPU 102. The accuracy requirement determiner 144 determines accuracy requirement required as detection accuracy of the toner amount (developer amount) by the developer amount detector 142, and functions as an accuracy requirement determiner. The accuracy requirement determiner 144 determines that the accuracy requirement is high when the controller 147 described below determines that the developer amount is in a range of a predetermined amount including a preset lower limit amount or in a range of a predetermined amount including a preset upper limit amount. Further, the accuracy requirement determiner 144 determines that the accuracy requirement is low when the controller 147 determines that the developer amount is in a range of another developer amount. Further, the accuracy requirement determiner 144 sets the accuracy requirement to highest accuracy requirement when the controller 147 determines that the detected developer amount is shifted from the predicted toner amount (predicted developer amount) by a predetermined amount or more.

The detection count setting unit 143 is built by the CPU 102. The detection count setting unit 143 sets the number of times of detection of the developer amount by the developer amount detector 142 based on the accuracy requirement determined by the accuracy requirement determiner 144, and functions as the detection count setting unit. The detection count setting unit 143 sets the number of times of detection of the developer amount by the developer amount detector 142 of when the accuracy requirement is high larger than that of when the accuracy requirement is low.

The controller 147 is built by the CPU 102. The controller 147 determines the toner amount that is the developer amount in the toner container 141*a* based on the detection result of the developer amount detector 142, and starts the supply of the toner Tu by the supply unit 146 when the controller 147 determines that the toner amount is a predetermined lower limit amount set in advance or less. Further, the controller 147 stops the supply of the toner Tu by the supply unit 146 when the controller 147 determines that the toner amount is a predetermined upper limit amount set in advance or more, and functions as a control unit.

Further, the controller 147 predicts a predicted toner amount from the supply amount of the toner Tu by the supply unit 146 and the consumption amount of the toner Tu by the developing section 141, using a change point of increase/decrease tendency of the toner amount of when the developer amount detector 142 is performing detection in the largest number of times of detection, as a starting point. The controller 147 then determines the range of a predetermined amount including the lower limit amount and the range of a predetermined amount including the upper limit amount based on the predicted toner amount. In this case, the accuracy requirement determiner 144 determines that the accuracy requirement is high when the controller 147 determines that the toner amount is in the range of a predetermine amount including the lower limit amount or in the range of a predetermined amount including the upper limit amount, and determines that the accuracy requirement is low when the controller 147 determines that the toner amount is in the range of another toner amount.

Further, the controller 147 smooths the detection result of the developer amount detector 142 in the rotation period T of the stirring portion 141*b*, and determines the toner amount from a smoothing result. Note that, as described above, the developer amount detector 142 detects the developer amount in the detection period that is shorter than the rotation period T of the stirring portion 141*b*.

Further, the controller 147 determines whether the toner amount detected by the developer amount detector 142 is shifted from the predicted toner amount by a predetermined amount or more. The accuracy requirement determiner 144 then sets the accuracy requirement to the highest accuracy requirement when the controller 147 determines that the detected toner amount is shifted from the predicted toner amount by the predetermined amount or more.

Next, functions of the present embodiment will be described. The image forming apparatus 1 of the present embodiment performs appropriately accurate detection of the toner amount (developer amount) while maintaining the utility.

That is, the developer amount detector 142 of the developing device 140 of the image forming apparatus 1 performs detection of the toner amount in every predetermined detection period, smooths the detection result, and determines the toner amount in the toner container 141*a*. The controller 147 drives the supply unit 146, and starts supply of the toner Tu in the supply container 145 to the developing section 141 when the toner amount becomes the lower limit amount or less, and stops the supply of the toner Tu by the supply unit 146 when the toner amount becomes the upper limit amount or more.

Then, as illustrated in FIG. 6, the image forming apparatus 1 has different influences on productivity in a case MI where the number of times of measurement M of the transmission time that is a detection time by the developer amount detector 142 is large, and in a case of Ms where the number of times of measurement is small. That is, as illustrated in FIG. 6, in the case MI where the number of times of measurement M is large, the detection accuracy is high and the detection time is long, and the toner detection operation is continued after the image formation operation is completed. Therefore, a downtime in the image formation operation occurs by the continuation of the toner detection operation, and the productivity is deteriorated. In contrast, as illustrated in FIG. 6, in the case Ms where the number of times of measurement M is small, the detection accuracy is low and the detection time is short, and the toner detection operation is terminated at the time when the image formation operation is completed. Therefore, no downtime occurs, and the productivity is improved.

Figure 7:
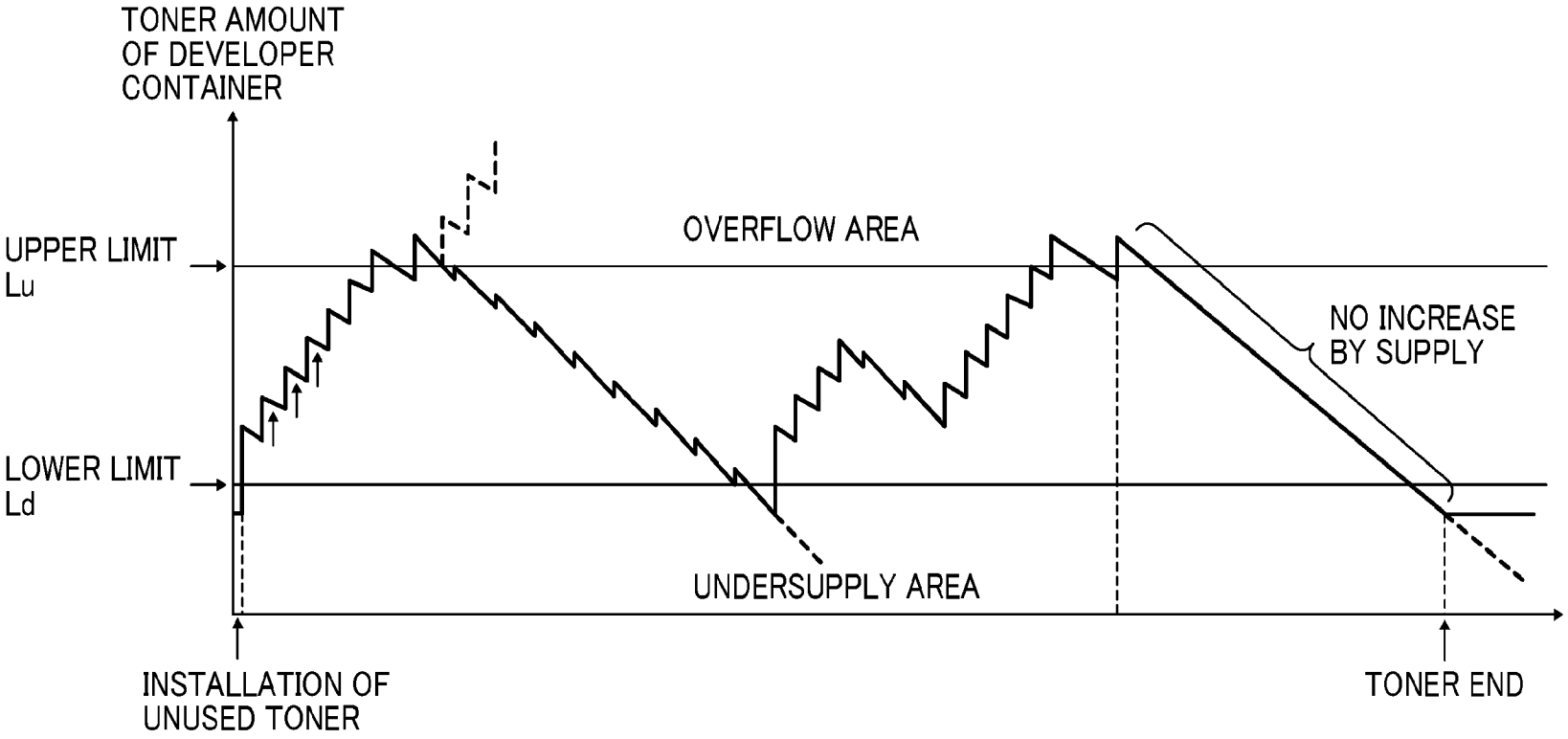
FIG. 7 is a diagram illustrating states of a toner amount and toner supply in a toner container according to an embodiment.

Meanwhile, as illustrated in FIG. 7, the image forming apparatus 1 sets the upper limit amount Lu and the lower limit amount Ld to the toner amount in the toner container 141*a* of the developing section 141. Then, the image forming apparatus 1 drives the supply unit 146 to supply the toner Tu in the supply container 145 to the toner container 141*a* when the toner amount in the toner container 141*a* of the developing section 141 falls below the lower limit amount Ld. Further, the image forming apparatus 1 stops the driving of the supply unit 146 to stop the supply of the toner Tu from the supply container 145 to the toner container 141*a* when the toner amount in the toner container 141*a* exceeds the upper limit amount Lu.

When performing such a supply operation of the toner Tu, the toner amount in the toner container 141*a* needs to be accurately detected near the upper limit amount Lu and the lower limit amount Ld in order to prevent overflow of the toner Tu due to oversupply of the toner Tu or blur of an image due to undersupply of the toner Tu. However, between the upper limit amount Lu and the lower limit amount Ld, in performing supply start and supply stop of the toner, accuracy required near the upper limit amount Lu and the lower limit amount Ld is not required in the toner amount detected by the developer amount detector 142.

Figure 8:
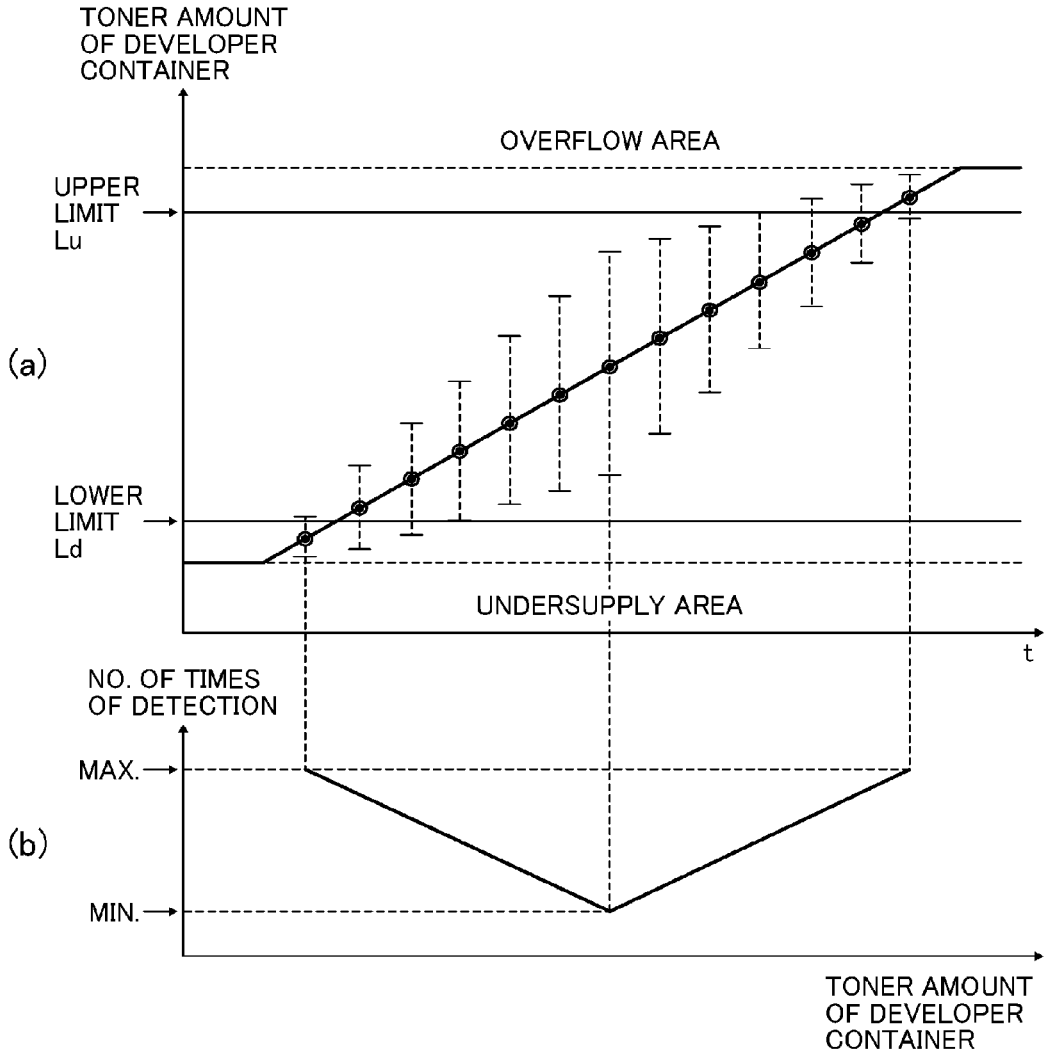
FIG. 8 is a diagram illustrating relationship between variation allowance and the number of times of detection in toner amount detection according to an embodiment.

Therefore, as illustrated in FIG. 8, the image forming apparatus of the present embodiment suppresses variation and improves the detection accuracy by increasing the number of times of toner detection by the developer amount detector 142 when the toner amount in the toner container 141*a* is near the upper limit amount Lu or the lower limit amount Ld. Further, the image forming apparatus 1 suppresses the downtime and improves the productivity by decreasing the number of times of toner detection by the developer amount detector 142 and allowing some extent of variation when the toner amount is between near the upper limit amount Lu and near the lower limit amount Ld. Note that, in (a) of FIG. 8, the graph illustrated by the straight line illustrates change of the toner amount, and a black circle illustrates the toner amount of the detection result by the developer amount detector 142. A detected toner amount by the developer amount detector 142 is an average value (smoothed value) of a plurality of times of detection results detected by the developer amount detector 142 during a detection period. Further, in (a) of FIG. 8, a broken line extending from the black circle of the detection result in the up and down direction illustrates a range of variation of the detected toner amount by the developer amount detector 142 at the time of the detection. Further, (b) of FIG. 8 illustrates change of the number of times of toner detection by the developer amount detector 142 corresponding to the toner amount in the toner container 141*a*, taking the maximum number of times near the upper limit amount Lu and near the lower limit amount Ld, and the minimum number of times near the central position. That is, the image forming apparatus 1 decreases the number of times of detection near the center of the upper limit amount Lu and the lower limit amount Ld where the variation of the toner detection amount is allowed and increases the number of times of detection near the upper limit amount Lu and the lower limit amount Ld where an allowable range of variation is narrow, and performs detection of the toner amount.

Figure 9:
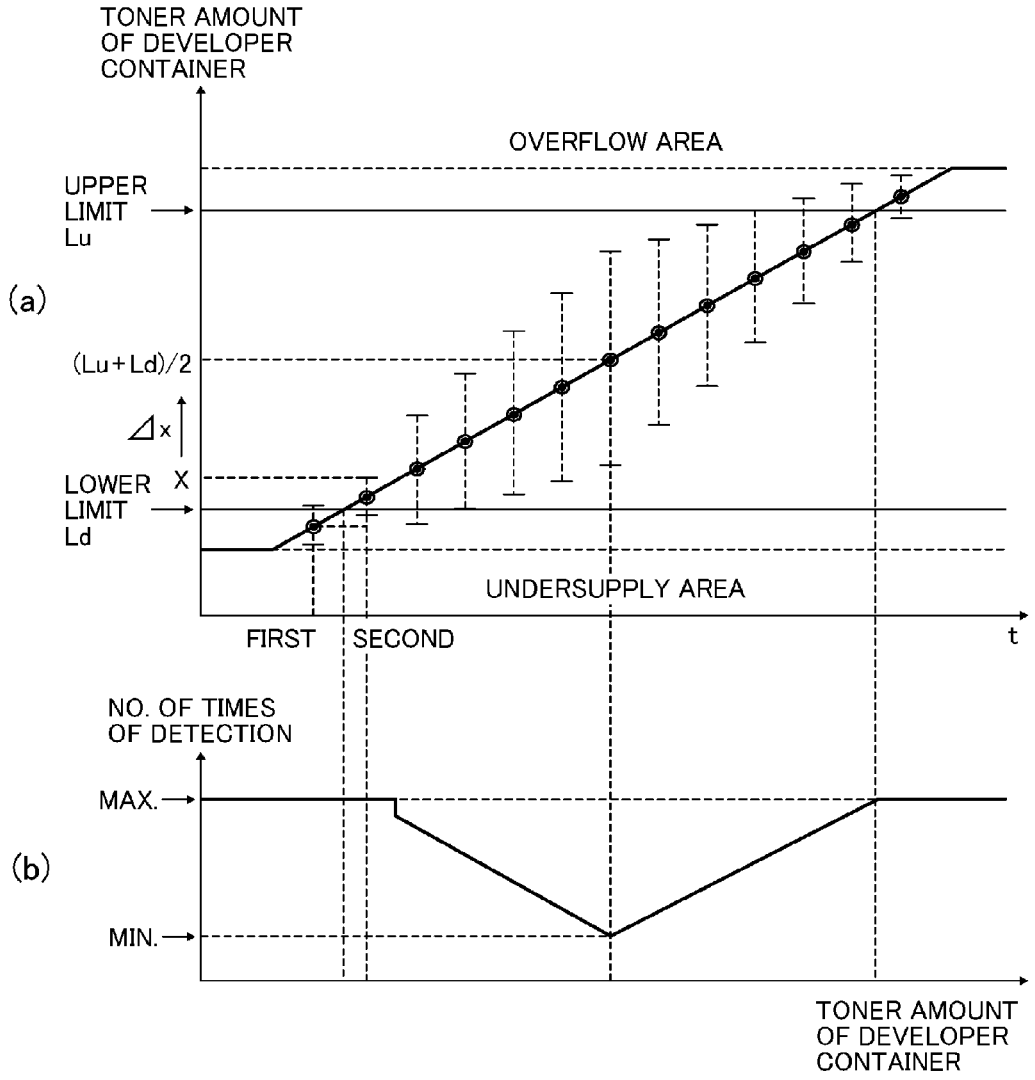
FIG. 9 is an illustration of edge detection near a lower limit amount according to an embodiment.
Figure 10:
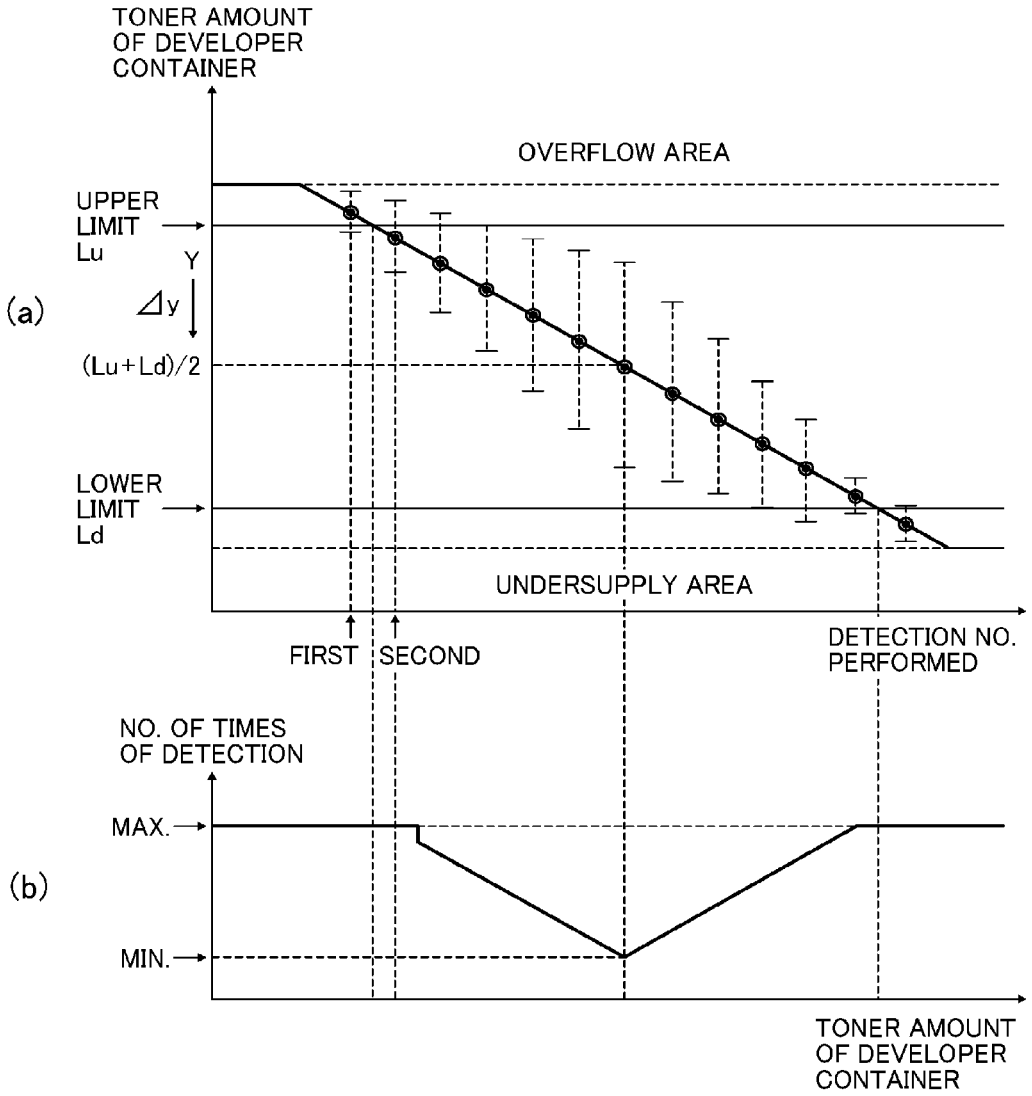
FIG. 10 is an illustration of the edge detection near an upper limit according to an embodiment.

Further, when controlling the number of times of toner detection in consideration of unusual change of the toner Tu, it is important to predict the toner amount in the toner container 141*a*, and control the number of times of toner detection based on a predicted toner amount. Then, as illustrated in FIGS. 9 and 10, the image forming apparatus 1 obtains the predicted toner amount in consideration of the supply amount of the toner Tu by the supply unit 146 and the consumption amount of the toner Tu based on the image data, and controls the number of times of toner detection based on the predicted toner amount, in addition to the detection of the toner amount by the developer amount detector 142. Further, the image forming apparatus 1 obtains prediction of the toner amount in the toner container 141*a* (predicted toner amount) from the supply amount of the toner Tu by the supply unit 146 and the consumption amount of the toner Tu based on the image data, using a change point of the increase/decrease of the toner amount, as a starting point, in the calculation of the predicted toner amount.

That is, FIG. 9 illustrates a state of edge detection near the lower limit amount Ld. Change edge detection near the lower limit amount Ld means toner detection where a toner detection amount of a previous time becomes smaller than the range of variation in the next toner detection, when the number of times of toner amount detection is a preset maximum number of times of detection near the lower limit amount Ld. In (a) of FIG. 9, the detection value (black circle) of the first time is smaller than the range of variation (the range illustrated by the broken line in (a) of FIG. 9) occurring for the detection value (black circle) of the second time, and thus the image forming apparatus 1 employs this detection as the edge detection. When the image forming apparatus 1 has performed the edge detection near the lower limit amount Ld, as illustrated in (b) of FIG. 9, the image forming apparatus 1 sequentially reduces the number of times of toner detection by the developer amount detector 142 after the edge detection at a predetermined rate, and has the minimum number of times of detection near the center of the upper limit amount Lu and the lower limit amount Ld. The image forming apparatus 1 adds a toner amount X at the time of the edge detection, and a toner increase amount Δx obtained from a cumulative supply amount Δp of the toner Tu accumulated after the change edge detection and a cumulative consumption amount Δγ of the toner Tu to predict the toner amount in the toner container 141*a* (predicted toner amount). The image forming apparatus 1 makes the toner amount detection accuracy higher as the toner amount approaches the upper limit amount Lu.

Further, FIG. 10 illustrates a state of the edge detection near the upper limit amount Lu. Change edge detection near the upper limit amount Lu means toner detection where the toner detection amount of the previous time becomes larger than the range of variation in the next toner detection, when the number of times of toner amount detection is the preset maximum number of times of detection near the upper limit amount Lu. The detection value (black circle) of the first time is smaller than the range of variation (the range illustrated by the broken line in (a) of FIG. 10) occurring for the detection value (black circle) of the second time in (a) of FIG. 10, and thus the image forming apparatus 1 employs this detection as the edge detection. When the image forming apparatus 1 has performed the edge detection, as illustrated in (b) of FIG. 10, the image forming apparatus 1 sequentially reduces the number of times of toner detection by the developer amount detector 142 after the edge detection at a predetermined rate, and takes the minimum number of times of detection near the center of the upper limit amount Lu and the lower limit amount Ld. When the image forming apparatus 1 has performed the edge detection near the upper limit amount Lu, as illustrated in (b) of FIG. 10, the image forming apparatus 1 sequentially reduces the number of times of toner detection by the developer amount detector 142 after the edge detection at a predetermined rate, and has the minimum number of times of detection near the center of the upper limit amount Lu and the lower limit amount Ld. The image forming apparatus 1 subtracts the toner amount Y at the time of the edge detection, and a toner decrease amount Δy obtained from the cumulative consumption amount of the toner Tu accumulated after the change edge detection to predict the toner amount in the toner container 141*a* (predicted toner amount). The image forming apparatus 1 makes the toner amount detection accuracy higher as the toner amount approaches the lower limit amount Ld. Note that the image forming apparatus 1 does not use the cumulative supply amount Δp because no toner Tu is supplied by the supply unit 146 from the upper limit amount Lu toward the lower limit amount Ld.

Here, since the toner container 141*a* is supplied the toner Tu while consuming the toner Tu by the image formation operation, the controller 147 calculates the toner increase amount Δx [g] by the following formula (1).

$$\Delta x = \Delta p - \Delta y \tag{1}$$

Further, the controller 147 calculates the cumulative supply amount Δp by the following formula (2) from a toner amount V [g/sec] conveyed per preset unit time, and a time t [sec] from when the driving of the supply unit 146 is started to when the driving is stopped.

$$\Delta p = \Delta p + V \times t \tag{2}$$

Note that the controller 147 calculates the toner consumption amount Δy [g] by accumulating the toner consumption amount of each one page of the image data.

Figure 11:
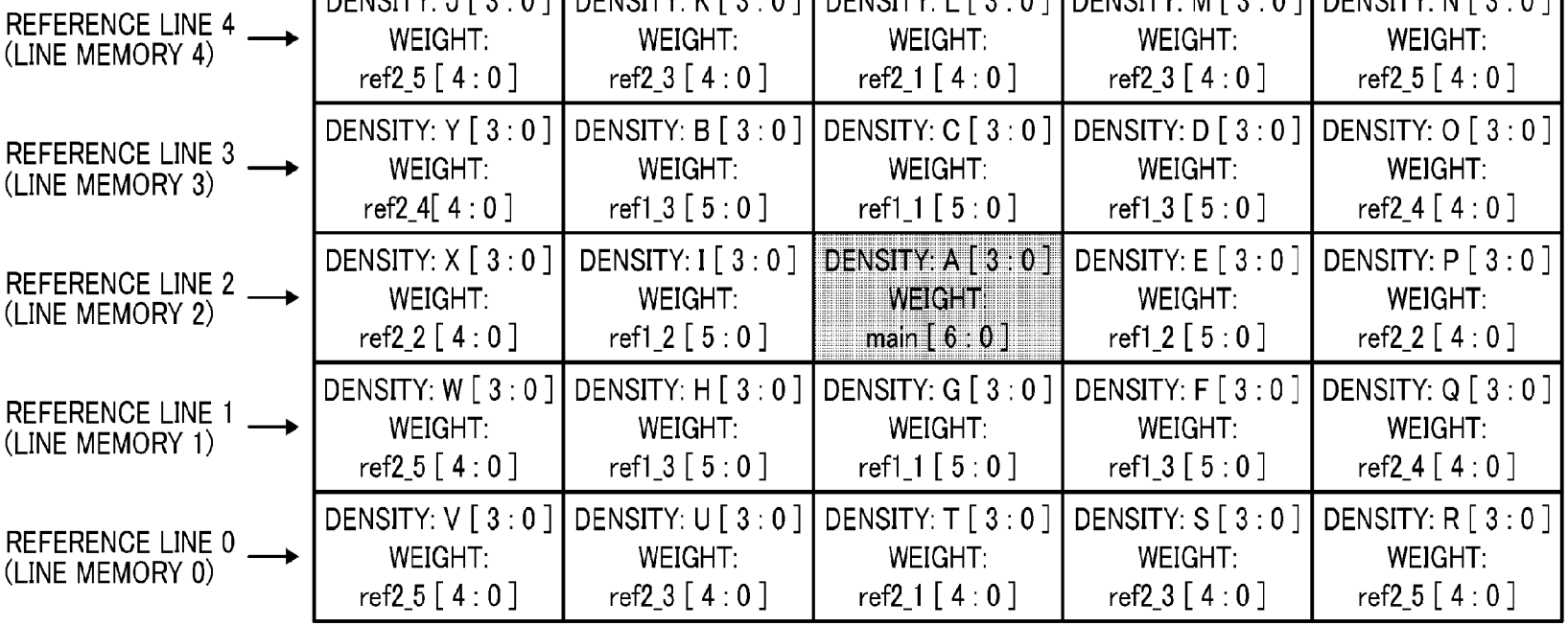
FIG. 11 is a diagram illustrating an example of a matrix used for calculation of a toner consumption amount according to an embodiment.

Then, the controller 147 calculates the toner consumption amount Δy based on the image data. In this case, the controller 147 uses a matrix as illustrated in FIG. 11. That is, the controller 147 extracts data of five pixels in a main-scanning direction and five pixels in a sub-scanning direction from the image data, and generates a 5×5 matrix around a pixel A of interest. At this time, the controller 147 performs γ conversion of density data in advance in accordance with characteristics of the exposure device 63. The controller 147 sets weighting coefficients to reference pixels B to I adjacent by one pixel, and reference pixels J to Y adjacent by two pixels, including the pixel A of interest, respectively, and calculates a total light amount of the pixel A of interest by the following formula (3). Note that, as the weighting coefficients, a common value is used between the reference pixels in a symmetrical relationship across the pixel A of interest.

$$\text{The total light amount of the pixel } A \text{ of interest} = A \times \text{main} + (C+G) \times \text{ref1-1} + (E+I) \times \text{ref1-2} + (B+D+F+H) \times \text{ref1-3} + (L+T) \times \text{ref2-1} + (P+X) \times \text{ref2-2} + (K+M+S+U) \times \text{ref2-3} + (O+Q+W+Y) \times \text{ref2-4} + (J+N+R+V) \times \text{ref2-5} \tag{3}$$

Further, the amount of consumed toner Tu by development is proportional to the light amount to expose the photoconductors 71K, 71M, 71C, and 71Y. However, the amount of consumed toner Tu is saturated at a certain light amount level (upper limit value), and is not developed after the light amount level. That is, no toner Tu is consumed. Therefore, the controller 147 performs saturation processing of the total light amount of the pixel A of interest by the following formula.

The total light amount of the pixel A of interest≤ the upper limit value→the corresponding value (X) of the toner consumption amount=the total light amount of the pixel A of interest The total light amount of the pixel A of interest>the upper limit value→the corresponding value (X) of the toner consumption amount=the upper limit value Further, the controller 147 subtracts a certain amount of offset value, like the following formula, in order to approximate the corresponding value of the toner consumption amount Δy calculated from the total light amount of the pixel A of interest to the amount of the toner Tu actually used in the development. Note that a subtraction result is a minus value, the result is made "0".

The corresponding value of the toner consumption amount per pixel=the total light amount of the pixel A of interest−the offset value The controller 147 performs the processing of obtaining the corresponding value of the toner consumption amount, for all the pixels in one page to be printed, and calculates the toner consumption amount Δy that is a total of the corresponding values of the toner consumption amounts of the one page. Note that the controller 147 treats peripheral pixels as pixels having the light amount being "0", when the peripheral pixels of the pixel A of interest are outside the image region.

Figure 12:
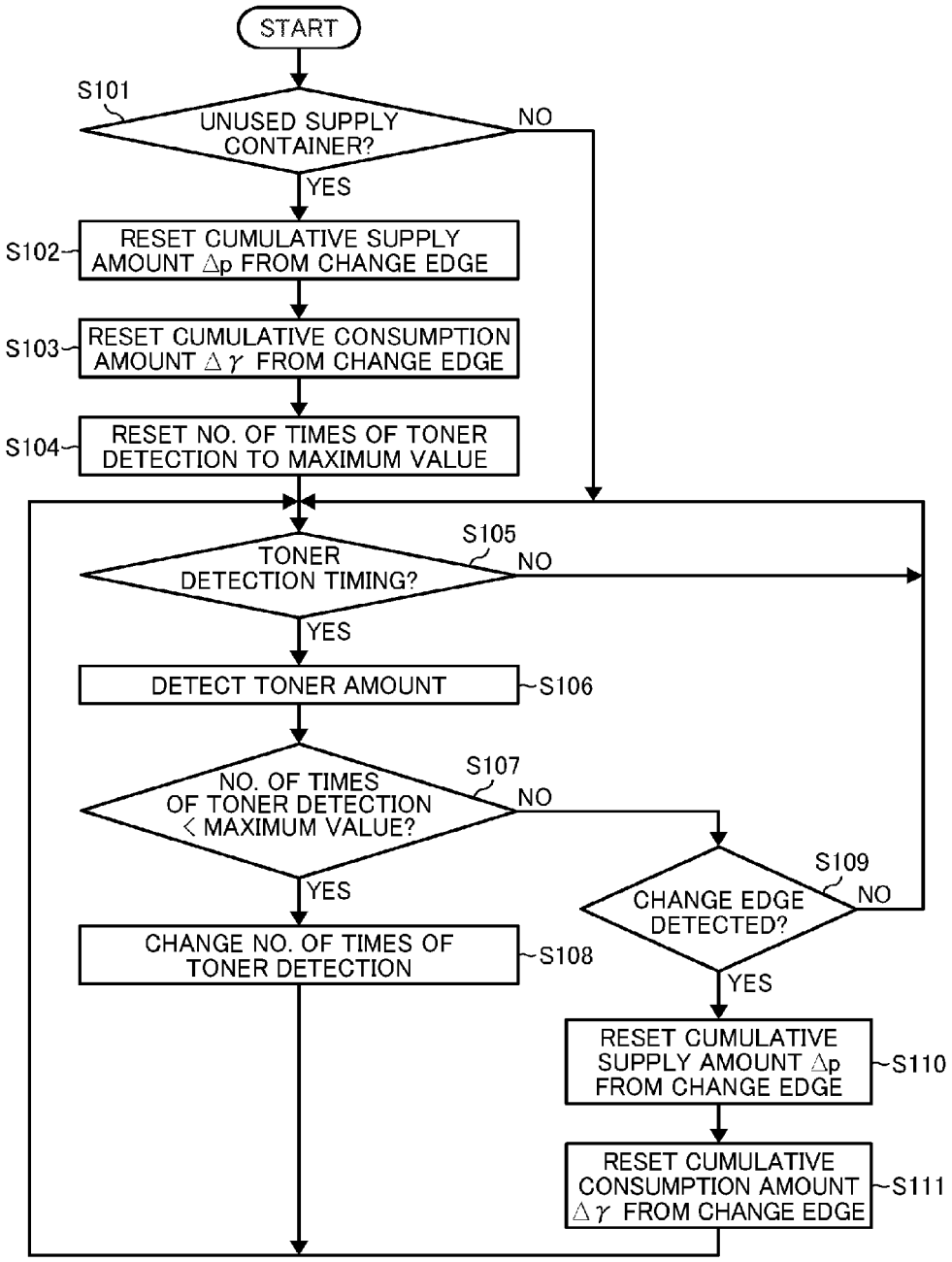
FIG. 12 is a flowchart illustrating toner amount detection processing according to an embodiment.

Then, the image forming apparatus 1 performs toner amount detection processing illustrated in FIG. 12 under control of the controller 147. That is, in the toner amount detection processing, the controller 147 first checks whether the supply container 145 is a new one, that is, whether the toner Tu is replaced and in a full state (step S101). When the supply container 145 is a new one (YES at step S101), the controller 147 resets the cumulative supply amount (toner consumption amount) Δp from the change edge detection to "0" (step S102), and resets the cumulative consumption amount Δγ from the change edge to "0" (step S103). The change edge detection in the cumulative supply amount Δp from the change edge detection includes the change edge detection neat the lower limit amount Ld of the toner amount and the change edge detection near the upper limit amount Lu of the toner amount, as described above. The change edge detection near the lower limit amount Ld means the toner detection where the toner detection amount of the previous time becomes smaller than the range of variation in the next toner detection, when the number of times of toner amount detection is the preset maximum number of times of detection near the lower limit amount Ld. The change edge detection near the upper limit amount Lu means the toner detection where the toner detection amount of the previous time becomes the range of variation in the next toner detection, when the number of times of toner amount detection is the preset maximum number of times of detection near the upper limit amount Lu.

Next, the controller 147 resets the number of times of toner detection to the maximum value (the maximum number of times) (step S104), and checks whether the toner detection period (sampling period) has arrived (step S105). This toner detection period (sampling period) is a period shorter than the rotation period T of the stirring portion 141*b* as the stirring screw 80.

At step S105, when the toner detection period has not yet arrived (NO at step S105), the controller 147 detects whether the toner detection period has arrived again, and when the toner detection period has arrived (YES at step S105), the controller 147 performs the toner amount detection (step S106). The controller 147 acquires the toner amount detection result (detection signal) by the developer amount detector 142, acquires the transmission time Δt, and calculates the average value (smoothed value), thereby to detect the toner amount.

The controller 147 checks whether the number of times of toner detection is less than the maximum value of the present number of times of toner detection (step S107).

At step S107, when the number of times of toner detection is less than the maximum value (YES at step S107), the controller 147 changes the number of times of toner detection, returns to step S105, and performs processing similarly to the above description (steps S105 to S108). The controller 147 changes the number of times of toner detection based on the toner increase amount Δx and the toner decrease amount (cumulative consumption amount) Δy.

The controller 147 then sequentially executes the processing of steps S105 to S108. At step S107, when the number of times of toner detection becomes the maximum value (NO at step S107), the controller 147 checks whether having detected the change edge (step S109). That is, the controller 147 compares the toner amount detected in the previous time and the range of variation of the toner amount detected this time, and checks whether having detected the change edge.

At step S109, when having detected no change edge (NO at step S109), the controller 147 returns to step S105, and performs processing similarly to the above description from the check as to whether the toner detection period has arrived (steps S105 to S109).

At step S109, when having detected the change edge (YES at step S109), the controller 147 resets the cumulative supply amount Δp from the change edge to "0" (step S110). Further, the controller 147 resets the cumulative consumption amount Δy from the change edge to "0" (step S111).

The controller 147 then returns to step S105, and performs processing similarly to the above description (steps S105 to S111).

At step S101, when the supply container 145 is not a new one (NO at step S101), the controller 147 then is moved onto step S105, and performs processing similarly to the above description from the check of the toner detection period (steps S105 to S111).

In doing so, the number of times of toner detection is maximized near the upper limit amount Lu and near the lower limit amount Ld and the detection accuracy can be improved, and the number of times of toner detection is decreased toward the center between near the upper limit amount Lu and near the lower limit amount Ld and the productivity can be improved. Therefore, the appropriately accurate toner amount (developer amount) can be detected.

Note that the above description has been given on the assumption that there is no substantial difference between the predicted toner amount and the actually detected toner amount. However, in practice, the predicted toner amount and the actually detected toner amount may have a certain level of difference.

Figure 13:
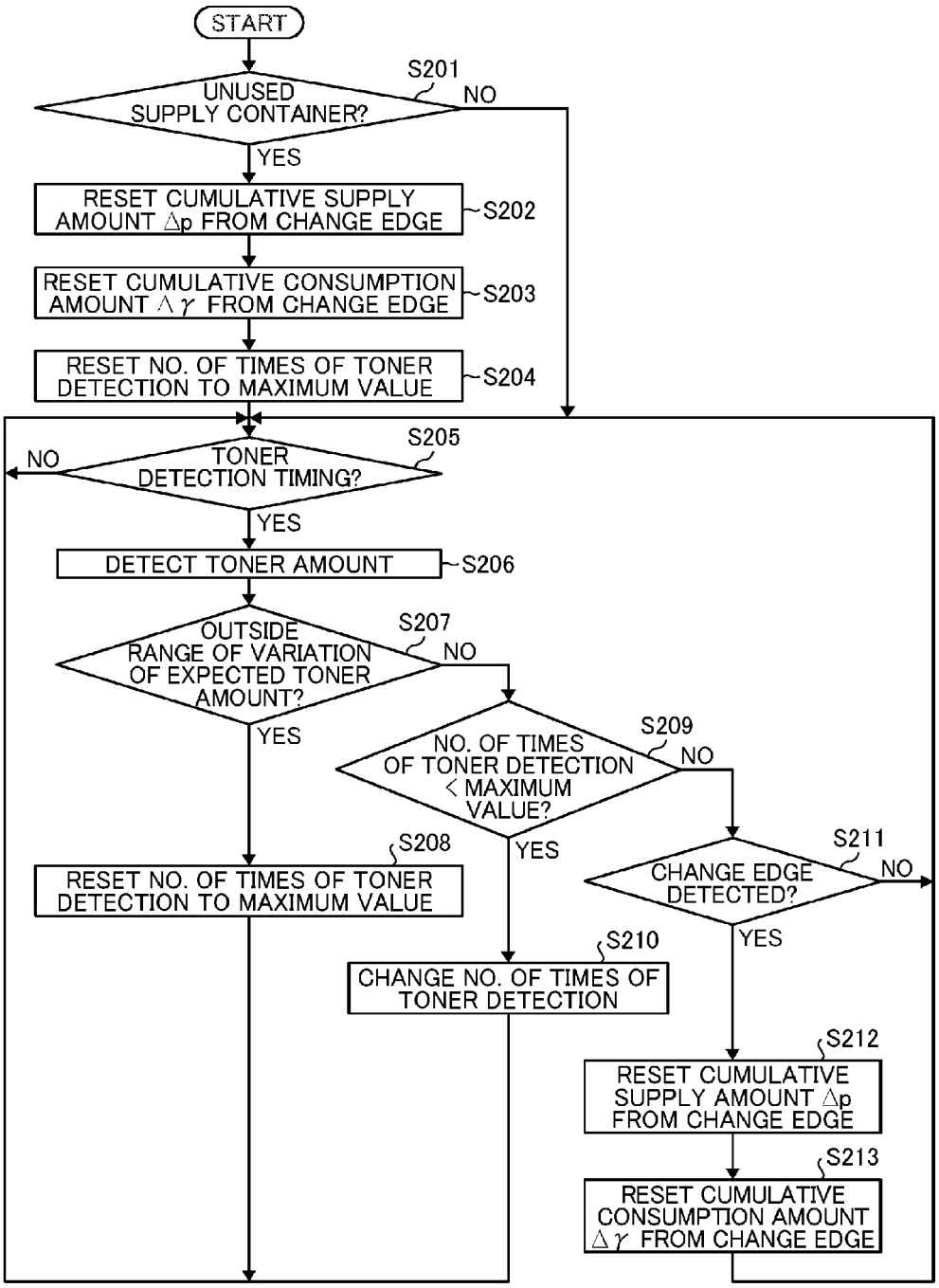
FIG. 13 is a flowchart illustrating the toner amount detection processing in consideration of unusual change of the toner amount according to an embodiment.

Therefore, as illustrated in FIG. 13, the image forming apparatus 1 of the present embodiment performs correction of the number of times of toner detection when the actually detected toner amount deviates from the predicted toner amount by a predetermined amount so as to improve the toner amount detection accuracy. Note that, in FIG. 13, the same step number is applied to the similar processing step to FIG. 12, and description thereof is simplified.

In FIG. 13, the controller 147 checks whether the supply container 145 is a new one (step S101). When the supply container 145 is a new one, the supply container 145 resets the cumulative supply amount Δp from the change edge detection to "0" (step S102). Further, the controller 147 resets the cumulative consumption amount Δγ from the change edge to "0" (step S103).

Next, the controller 147 resets the number of times of toner detection to the maximum value (the maximum number of times) (step S104), and checks whether the toner detection period (sampling period) has arrived (step S105).

At step S105, when the toner detection period has not yet arrived, the controller 147 detects whether the toner detection period has arrived again, and when the toner detection period has arrived, the controller 147 detects the toner amount (step S106).

Figure 14:
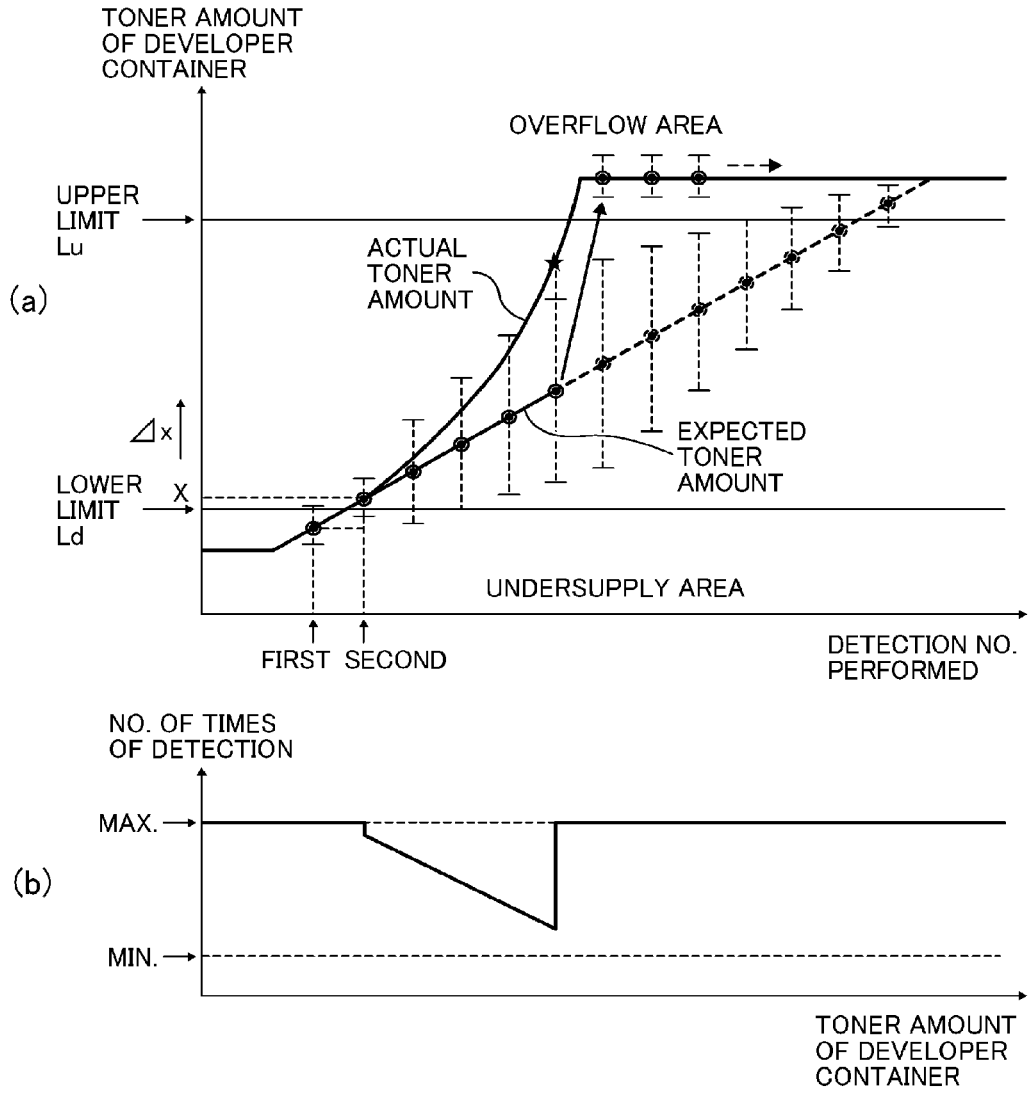
FIG. 14 is a diagram illustrating an example of a case where an actual toner amount exists above a variation range of a predicted toner amount according to an embodiment.
Figure 15:
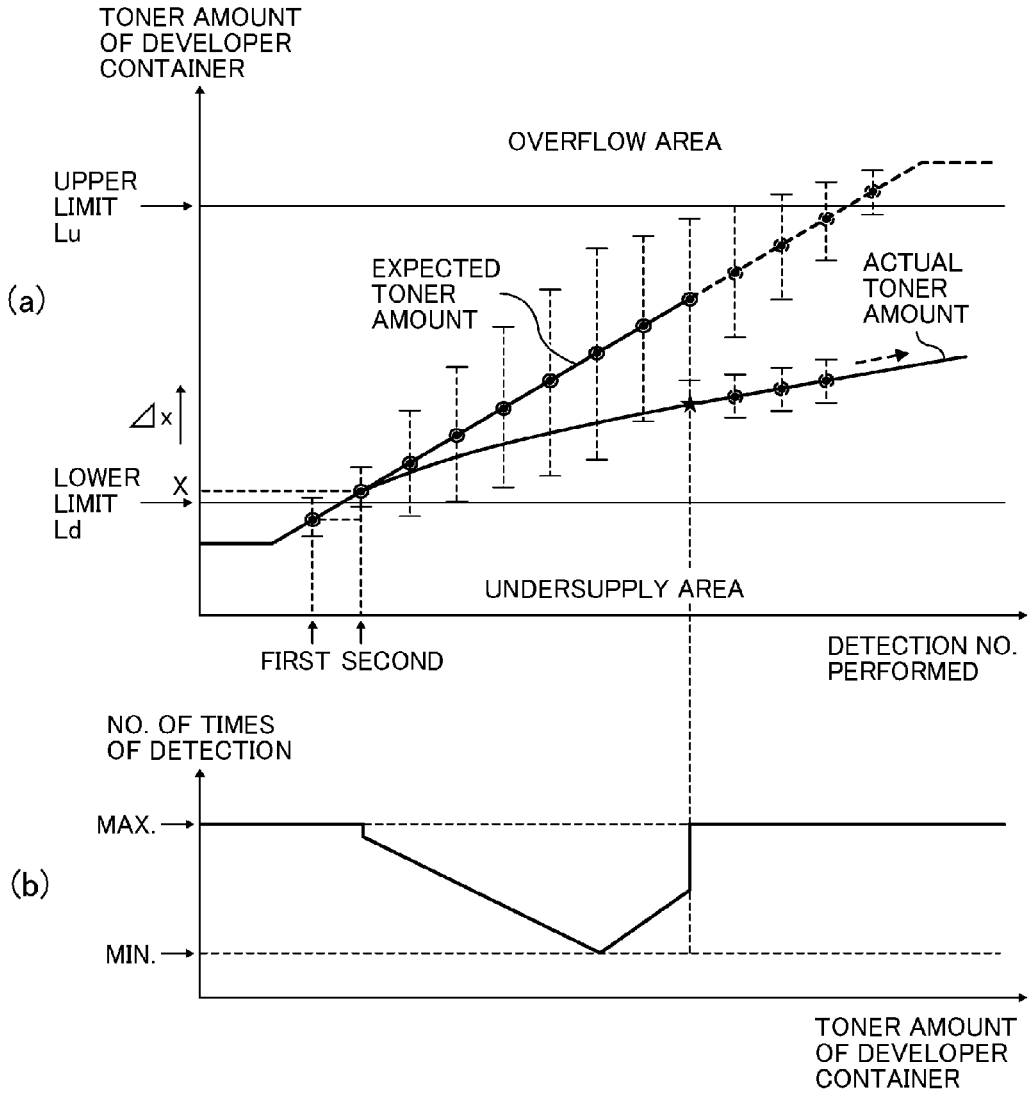
FIG. 15 is a diagram illustrating an example of a case where the actual toner amount exists below the variation range of the predicted toner amount according to an embodiment.

The controller 147 checks whether the detected toner amount exceeds the range of variation of a predicted toner amount (step S201). That is, as illustrated in FIGS. 14 and 15, the controller 147 checks whether the detected toner amount exceeds the variation range of a predicted toner amount toward an upper side (in the case of (a) of FIG. 14), or toward a lower side (in the case of (a) of FIG. 15). Note that, in (a) of FIG. 14 and (a) of FIG. 15, with respect to the predicted toner amount, the range illustrated by the upper and lower broken lines in the toner amount detection position (the position indicated by the black circle) indicates the variation range, and the variation range depends on the number of times of toner detection in the toner amount detection position.

At step S201, when the detected toner amount does not exceed the range of variation of a predicted toner amount (NO at step S201), the controller 147 similarly checks whether the number of times of toner detection is less than the maximum value of the number of times of toner detection (step S107).

At step S107, when the number of times of toner detection is less than the maximum value, the controller 147 changes the number of times of toner detection, returns to step S105, and performs processing similarly to the above description (steps S105 to S108).

The controller 147 then sequentially executes the processing of steps S105, S106, S201, S107, and S108, and when the number of times of toner detection becomes the maximum value at step S107, the controller 147 checks whether having detected the change edge (step S109).

At step S109, when having detected no change edge, the controller 147 returns to step S105, and performs processing similarly to the above description from the check as to whether the toner detection period has arrived (steps S105, S106, S201, and S107 to S109).

At step S109, when having detected the change edge, the controller 147 resets the cumulative supply amount Δp from the change edge to "0" (step S110). Further, the controller 147 resets the cumulative consumption amount Δy from the change edge to "0" (step S111).

The controller 147 then returns to step S105, and performs processing similarly to the above description (steps S105, S106, S201, and S107 to S111).

At step S201, when the detected toner amount exceeds the range of variation of a predicted toner amount (YES at step S201), the controller 147 resets the number of times of toner detection to the maximum value, as illustrated in (b) of FIG. 14 and (b) of FIG. 15 (step S202).

After the controller 147 resets the number of times of toner detection to the maximum value, the controller 147 returns to step S105, and performs processing similarly to the above description from the check processing as to whether the toner detection period has arrived (step S105, S106, S201, S202, S107 to S111).

In doing so, when the actual toner amount largely deviates from the predicted toner amount, the number of times of toner detection is reset to the maximum value, and the toner can be detected in a highly accurate manner, whereby the detection accuracy of the toner amount can be improved, and occurrence of overflow of the toner and the blur of the image can be prevented.

As described above, in the image forming apparatus 1 of the present embodiment, the developing device 140 includes the toner container 141*a* that stores the toner (developer) Tu, the developing section (development unit) 141 that supplies the toner Tu in the toner container 141*a* to the photoconductors (latent image bearers) 71K, 71M, 71C, and 71Y where the electrostatic latent images are formed according to the image data, and forms the toner images (developer images), the developer amount detector 142 that detects the toner amount in the toner container 141*a* of the developing section 141 at a predetermined detection period, the accuracy requirement determiner 144 that determines the accuracy requirement required as the detection accuracy of the toner amount by the developer amount detector 142, and the detection count setting unit 143 that sets the number of times of detection of the developer amount by the developer amount detector based on the accuracy requirement.

Therefore, the toner amount can be detected by the number of times of detection according to the accuracy requirement, and the appropriately accurate detection of the toner amount can be performed while the utility is maintained.

Further, in the image forming apparatus 1 of the present embodiment, the developing device 140 executes a developer amount detection method including the steps of developing processing of providing the toner Tu in the toner container 141*a* to the photoconductors 71K, 71M, 71C, and 71Y where the electrostatic latent images are formed according to the image data by the developing section (development unit) 141 including the toner container 141*a* that store the toner Tu and forming the toner image, developer amount detecting processing of detecting the toner amount in the toner container 141*a* of the developing section 141 in every detection period, accuracy requirement determining processing of determining the accuracy requirement required as the detection accuracy of the toner amount in the step of developer amount detecting processing, and the detection count setting processing of setting the number of times of detection of the developer amount in the step of developer amount detecting processing based on the accuracy requirement.

Therefore, the toner amount can be detected by the number of times of detection according to the accuracy requirement, and the appropriately accurate detection of the toner amount can be performed while the utility is maintained.

Further, in the image forming apparatus 1 of the present embodiment, the developing device 140 mounts a developer amount detection program for causing a control processor such as the CPU 102 to execute developing processing of providing the toner Tu in the toner container 141*a* to the photoconductors 71K, 71M, 71C, and 71Y where the electrostatic latent images are formed according to the image data by the developing section 141 including the toner container 141*a* that store the toner Tu and forming the toner image, developer amount detecting processing of detecting the toner amount in the toner container 141*a* of the developing section 141 in every detection period, accuracy requirement determining processing of determining the accuracy requirement required as the detection accuracy of the toner amount in the developer amount detecting processing, and the detection count setting processing of setting the number of times of detection of the developer amount in the developer amount detecting processing based on the accuracy requirement, Therefore, the toner amount can be detected by the number of times of detection according to the accuracy requirement, and the appropriately accurate detection of the toner amount can be performed while the utility is maintained.

Further, in the image forming apparatus 1 of the present embodiment, the developing device 140 further includes the supply container 145 that stores the toner Tu, the supply unit 146 that supplies the toner Tu in the supply container 145 to the toner container 141*a*, and the controller (control unit) 147 that determines the toner amount in the toner container 141*a* based on the detection result of the developer amount detector 142, and starts the supply of the toner Tu to the toner container 141*a* by the supply unit 146 when the controller 147 determines having determined that the toner amount is the predetermined lower limit amount Ld or less, and stops the supply of the toner Tu by the supply unit 146 when the controller 147 determines that the toner amount is the predetermined upper limit amount Lu or more. The accuracy requirement determiner 144 determines that the accuracy requirement is high when the controller 147 determines that the toner amount is in the range of a predetermined amount including the lower limit amount Ld or in the range of a predetermined amount including the upper limit amount LU, and determines that the accuracy requirement is low when the controller 147 determines that the toner amount is in the range of another developer amount. The detection count setting unit 143 sets the number of times of detection of when the accuracy requirement is high to be larger than the number of times of detection of when the accuracy requirement is low.

Therefore, the number of times of detection is made large near the lower limit amount Ld where the supply of the toner Tu is started and near the upper limit amount Lu where the supply of the toner Tu is stopped, so that the detection accuracy is improved, and the number of times of detection is made small in other toner amount regions, so that the utility is improved. As a result, the toner amount can be appropriately detected by the number of times of detection according to the necessary accuracy requirement, and more appropriately accurate detection of the toner amount can be performed while the utility is more appropriately maintained.

Further, in the image forming apparatus 1 of the present embodiment, the controller 147 of the developing device 140 obtains the predicted toner amount (predicted developer amount) from the supply amount of the toner Tu by the supply unit 146 and the consumption amount of the toner Tu by the developing section 141, using the change point of the increase/decrease tendency of the toner amount of when the developer amount detector 142 is performing detection in the largest number of times of detection, as a starting point, and determines the range of a predetermined amount including the lower limit amount Ld and the range of a predetermined amount including the upper limit amount Lu based on the predicted toner amount.

Therefore, the toner amount is appropriately predicted, and the number of times of detection is made large near the lower limit amount Ld where the supply of the toner Tu is started and near the upper limit amount Lu where the supply of the toner Tu is stopped, so that the detection accuracy is improved, and the number of times of detection is made small in other toner amount regions, so that the utility is improved. As a result, the toner amount can be appropriately detected by the number of times of detection according to the necessary accuracy requirement, and more appropriately accurate detection of the toner amount can be performed while the utility is more appropriately maintained.

Further, in the image forming apparatus 1 of the present embodiment, the developing device 140 further includes the stirring screw (stirrer) 80 that stirs the toner Tu in the toner container 141*a* in a predetermined rotation period (stirring period) T, and the developer amount detector 142 detects the developer amount in the detection period that is shorter than the rotation period T as the detection period.

Therefore, even when the toner Tu in the toner container 141*a* is stirred with the stirring screw 80, the amount of stirred toner Tu can be accurately detected by the number of times of detection according to the necessary accuracy requirement. As a result, more appropriately accurate detection of the toner amount can be performed while the utility is appropriately maintained.

Further, in the image forming apparatus 1 of the present embodiment, the controller 147 of the developing device 140 smooths the detection result of the developer amount detector 142 in the rotation period T, and determines the toner amount from the smoothing result.

Therefore, even when the toner Tu in the toner container 141*a* is stirred with the stirring screw 80, the amount of the stirred toner Tu can be accurately detected by the number of times of detection according to the necessary accuracy requirement. As a result, more appropriately accurate detection of the toner amount can be performed while the utility is appropriately maintained.

Further, in the image forming apparatus 1 of the present embodiment, the controller 147 of the developing device 140 determines whether the toner amount detected by the developer amount detector 142 is shifted from the predicted toner amount by a predetermined amount or more, and the accuracy requirement determiner 144 sets the accuracy requirement to the highest accuracy requirement when the controller 147 determines that the detected toner amount is shifted from the predicted toner amount by the predetermined amount or more.

Therefore, when the detected toner amount is shifted from the predicted toner amount by the predetermined amount or more, the accuracy requirement is set to the highest accuracy requirement, so that the detection accuracy of the toner amount by the developer amount detector 142 can be improved. As a result, the toner amount can be appropriately detected by the number of times of detection according to the necessary accuracy requirement, and more appropriately accurate detection of the toner amount can be performed while the utility is more appropriately maintained.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC) and conventional circuit components arranged to perform the recited functions.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, hard disk, CD ROM, magnetic tape device or solid state memory device.

The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or nonvolatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

What is claimed is:

1. A developing device comprising:

a development container section including a toner container configured to store a developer, the development container section configured to supply the developer from the toner container to a latent image bearer, on which an electrostatic latent image is to be formed according to image data, to form a developer image;

a developer amount detector configured to detect a developer amount in the toner container of the development container section in every detection period;

an accuracy requirement determiner configured to determine an accuracy requirement required as a detection accuracy of the developer amount by the developer amount detector; and a detection count setting circuit configured to set a number of times of detection of the developer amount by the developer amount detector based on the accuracy requirement, wherein the accuracy requirement determiner is configured to determine that the accuracy requirement is high when the developer amount is in a predetermined upper range and when the developer amount is in a predetermined lower range, and when the accuracy requirement is high, the detection count setting circuit is configured to set a number of times of detection to be larger than a number of times of detection when the accuracy requirement is low.

2. The developing device according to claim 1, further comprising:

a supply container configured to store the developer;

a supplier configured to supply the developer from the supply container to the toner container; and a controller configured to determine the developer amount in the toner container based on a detection result of the developer amount detector, and start supply of the developer to the toner container by the supplier when the controller determines that the developer amount is a predetermined lower limit amount or less and stop the supply of the developer by the supplier when the controller determines that the developer amount is a predetermined upper limit amount or more.

3. The developing device according to claim 2, wherein the controller is configured to obtain a predicted developer amount from a supply amount of the developer by the supplier and a consumption amount of the developer by the development container section, using a change point of increase-and-decrease tendency of the developer amount of when the developer amount detector is performing detection in a largest number of times of detection, as a starting point, and determines the predetermined upper range and the predetermined lower range based on the predicted developer amount.

4. The developing device according to claim 1, further comprising:

a stirrer configured to stir the developer in the toner container in a predetermined stirring period, wherein the developer amount detector is configured to detect the developer amount in a detection period that is shorter than the stirring period, as said every detection period.

5. The developing device according to claim 4, wherein the controller is configured to smooth a detection result of the developer amount detector in the stirring period, and determines the developer amount from a smoothing result.

6. The developing device according to claim 3, wherein the controller is configured to determine whether the developer amount detected by the developer amount detector is shifted from the predicted developer amount by a predetermined amount or more, and the accuracy requirement determiner is configured to set the accuracy requirement to highest accuracy requirement when the controller determines that the detected developer amount is shifted from the predicted developer amount by the predetermined amount or more.

7. An image forming apparatus, comprising:

the image bearer configured to bear an electrostatic latent image based on image data;

the developing device according to claim 1 to supply the developer to the image bearer to form a developer image on the image bearer.

8. A method of detecting a developer amount, comprising:

supplying, by a development container section including a toner container to store a developer, the developer from the toner container to a latent image bearer, on which an electrostatic latent image is formed according to image data, to form a developer image;

detecting a developer amount in the toner container of the development container section in every detection period;

determining an accuracy requirement required as a detection accuracy of the developer amount by the detecting of the developer amount; and setting a number of times of detection of the developer amount in the detecting of the developer amount, based on the accuracy requirement, wherein the determining the accuracy requirement includes determining that the accuracy requirement is high when the developer amount is in a predetermined upper range and when the developer amount is in a predetermined lower range, and when the accuracy requirement is high, the setting the number of times of detection includes setting the number of times of detection to be larger than a number of times of detection when the accuracy requirement is low.

9. A non-transitory recording medium storing a program for causing a control processor to execute a method, the method comprising:

supplying, by a development container section including a toner container to store a developer, the developer from the toner container to a latent image bearer, on which an electrostatic latent image is formed according to image data, to form a developer image;

detecting a developer amount in the toner container of the development container section in every detection period;

determining an accuracy requirement required as a detection accuracy of the developer amount by the detecting of the developer amount; and setting a number of times of detection of the developer amount in the detecting of the developer amount, based on the accuracy requirement, wherein the determining the accuracy requirement includes determining that the accuracy requirement is high when the developer amount is in a predetermined upper range and when the developer amount is in a predetermined lower range, and when the accuracy requirement is high, the setting the number of times of detection includes setting the number of times of detection to be larger than a number of times of detection when the accuracy requirement is low.

* * * * *